US005407768A

United States Patent [19]

Akiyama et al.

[11] Patent Number: 5,407,768

[45] Date of Patent: Apr. 18, 1995

[54] LIGHT-RECEIVING MEMBER

[75] Inventors: Kazuyoshi Akiyama; Masaaki Yamamura, both of Nagahama; Ryuji Okamura, Shiga; Koji Hitsuishi, Nagahama, all of Japan

[73] Assignee: Canon Kabushiki Kaisha, Tokyo, Japan

[21] Appl. No.: 51,358

[22] Filed: Apr. 23, 1993

[30] Foreign Application Priority Data

Apr. 24, 1992 [JP] Japan ..... 4-106528

[51] Int. Cl.[6] ..... G03G 5/14

[52] U.S. Cl. ..... 430/65; 430/67; 430/95; 430/84

[58] Field of Search ..... 430/84, 95, 65, 67

[56] References Cited

U.S. PATENT DOCUMENTS 5,190,838 3/1993 Saitoh et al. ..... 430/84

FOREIGN PATENT DOCUMENTS 2746967 4/1979 Germany ..... G03G 5/082
2855718 6/1979 Germany ..... G03G 5/04
54-145540 11/1979 Japan ..... G03G 5/08
61-231561 10/1980 Japan ..... G03G 5/10
56-83746 7/1981 Japan ..... G03G 5/082
60-168156 8/1985 Japan ..... G03G 5/08
60-178457 9/1985 Japan ..... G03G 5/08
60-225854 11/1985 Japan ..... G03G 5/10
63-35026 7/1988 Japan ..... G03G 5/08

*Primary Examiner*—John Goodrow
*Attorney, Agent, or Firm*—Fitzpatrick, Cella, Harper & Scinto

[57] ABSTRACT

An electrophotographic light-receiving member comprising a conductive substrate 101 and laminated thereto a non-monocrystalline material photoconductive layer 102 and a surface layer 103. The photoconductive layer 102 is mainly composed of silicon atoms and contains at least carbon atoms and hydrogen atoms. The percentage of carbon atoms having a carbon-carbon bond in the photoconductive layer is controlled to be not more than 60% based on the whole carbon atoms contained therein, and, in an instance in which a blocking layer 104 is provided between the conductive substrate 101 and the photoconductive layer 102, the percentage of carbon atoms having a carbon-carbon bond in the blocking layer is also controlled. This makes it possible to prevent clusters of carbon atoms from being formed in the photoconductive layer or blocking layer. Making the carbon atoms have a uniform distribution in the silicon film enables improvement in electrophotographic performances such as charge performance, sensitivity, residual potential, ghost-free properties, etc.

43 Claims, 4 Drawing Sheets

LIGHT-RECEIVING MEMBER

BACKGROUND OF THE INVENTION

1. Field of the Invention

The present invention relates to a light-receiving member having a sensitivity to electromagnetic waves such as light (which herein refers to light in a broad sense and indicates ultraviolet rays, visible rays, infrared rays, X-rays, γ-rays, etc.), and more particularly to a light-receiving member that can be preferably used in electrophotography.

2. Related Background Art

In the field of image formation, photoconductive materials capable of forming light-receiving layers in light-receiving members are required to have properties such that they are highly sensitive, have a high SN ratio [light current (Ip)/dark current (Id)], have absorption spectra suited to spectral characteristics of electromagnetic waves to be radiated, have a high response to light, have the desired dark resistance and are harmless to human bodies when used. In particular, in the case of electrophotographic light-receiving members set in electrophotographic apparatus used in offices, the above safety in their use is an important point.

Photoconductive materials recently attracting notice from such a viewpoint include amorphous silicon (hereinafter "a-Si"). For example, German Patent Applications Laid-open No. 27 46 967 and No. 28 55 718 disclose its application in electrophotographic light-receiving members.

Japanese Patent Application Laid-open No. 56-83746 discloses an electrophotographic light-receiving member comprising an a-Si photoconductive layer secondary region containing a halogen atom as a component. This publication reports that incorporation of 1 to 40 atom % of halogen atoms into a-Si enables compensation of dangling bonds and decrease of localized level density in energy gaps to accomplish electrical and optical properties suitable as a photoconductive layer secondary region of an electrophotographic light-receiving member.

Meanwhile, amorphous silicon carbide (hereinafter "a-SiC") is known to promise a high heat resistance or surface hardness, have a higher dark resistance than a-Si and enable change of optical band gaps over a range of 1.6 to 2.8 eV depending on the content of carbon. Japanese Patent Application Laid-open No. 54-145540 discloses an electrophotographic light-receiving member in which a photoconductive layer is comprised of such an a-SiC. This publication shows that superior electrophotographic performances with a high dark resistance and a good photosensitivity can be exhibited when a-Si containing 0.1 to 30 atom % of carbon as a chemical modifier is used as a photoconductive layer of an electrophotographic light-receiving member.

Japanese Patent Publication No. 63-35026 also discloses an electrophotographic photosensitive member comprised of an a-Si intermediate layer containing a carbon atom and at least one of a hydrogen atom and a fluorine atom [hereinafter "a-SiC(H,F)] and an a-Si photoconductive layer, where the a-Si intermediate layer containing at lest a hydrogen atom and/or a fluorine atom is provided so that cracking or separation of the a-Si photoconductive layer can be decreased without damage of photoconductive properties.

These techniques have made it possible to obtain electrophotographic light-receiving members having good electrical properties.

The conventional electrophotographic light-receiving members having a photoconductive layer comprised of a-SiC have individually achieved improvements in properties in respect of electrical, optical and photoconductive properties and service environmental properties and also in respect of stability with time and durability. Under existing circumstances, however, there is room for further improvements to make their overall properties better.

Particularly in recent years, with spread of high-speed copying machines, digital copying machines, full-color copying machines and high-speed LBP, electrophotographic apparatus are sought to achieve higher image quality, higher speed and higher durability. As a result, electrophotographic light-receiving members are now required to be more free from faulty memory or images than ever and, in addition to further improvements in electrical properties or photoconductive properties, to raise charge performance and sensitivity to a level required when used at a high speed and at the same time achieve a great improvement in durability.

However, in an attempt to simultaneously achieve higher speed and higher dark resistance, more than a few conventional electrophotographic light-receiving members have been involved in difficulties such that residual potential is often seen to remain during their use and the use of light-receiving members of this type over a long period of time causes a phenomenon of what is called "ghost", which is an after-image caused by accumulation of fatigue due to repeated use.

For example, in conventional electrophotographic light-receiving members in which, for example, a blocking layer is provided in order to block injection of electrical charges from a support, it has been necessary to more efficiently block the injection of electrical charges by decreasing carbon content in the blocking layer or increasing the amount of doping of boron so that blocking performance can be improved, as means for improving blocking performance and achieving an improvement in charge performance and an improvement in dark decay. Any of these methods are effective means for improving blocking performance. They, however, have had the problem that side effects such as a lowering of the adhesion between a deposited film and the support or other layer such as photoconductive layer and a lowering of charge performance may occur.

SUMMARY OF THE INVENTION

The present invention was made taking account of the foregoing points, and aims at solution of the problems involved in electrophotographic light-receiving members having the conventional light-receiving layer comprised of the material mainly composed of silicon atoms as stated above.

That is, an object of the present invention is to provide an electrophotographic light-receiving member having a light-receiving layer comprised of a material mainly composed of silicon atoms, that is substantially always stable almost without dependence of electrical, optical and photoconductive properties on environment, has a superior resistance to fatigue by light and can be completely free or almost free from residual potential.

Another object of the present invention is to provide an electrophotographic light-receiving member having a light-receiving layer comprised of a material mainly composed of silicon atoms, that has a superior adhesion between a layer provided on a conductive substrate and the conductive substrate or between layers laminated thereon and has a dense and stable structural arrangement.

Still another object of the present invention is to provide an electrophotographic light-receiving member having a light-receiving layer comprised of a material mainly composed of silicon atoms, that is well capable of retaining charges in charging for the formation of electrostatic images and capable of exhibiting superior electrophotographic performances because of which conventional electrophotography can be very effectively applied, when it is applied as an electrophotographic light-receiving member.

A further object of the present invention is to provide an electrophotographic light-receiving member having a light-receiving layer comprised of a material mainly composed of silicon atoms, that has a high sensitivity, a high SN ratio characteristic and a high electrical breakdown strength.

A still further object of the present invention is to provide an electrophotographic light-receiving member having a light-receiving layer comprised of a material mainly composed of silicon atoms, that has been more improved in sensitivity in practical use because of an improvement in sensitivity in a short wavelength region, can be completely free or almost free from the phenomenon of "ghost", has a high dark resistance while maintaining residual potential at a low level and is substantially always stable almost without dependence of electrical, optical and photoconductive properties on environment, i.e., has superior temperature characteristics.

A still further object of the present invention is to provide an electrophotographic light-receiving member having a light-receiving layer comprised of a material mainly composed of silicon atoms, that has been more improved in electrical, optical and photoelectric properties and is capable of forming higher-quality stable images.

A still further object of the present invention is to provide an electrophotographic light-receiving member having a light-receiving layer comprised of a material mainly composed of silicon atoms, that has a superior adhesion between a layer provided on a conductive substrate and the conductive substrate or between layers laminated thereon, has a dense and stable structural arrangement and has a high layer quality.

A still further object of the present invention is to provide an electrophotographic light-receiving member having a light-receiving layer comprised of a material mainly composed of silicon atoms, that has been more improved in electrical, optical and photoelectrical properties and is capable of forming higher-quality stable images so that it can be set on copying machines with higher performance as exemplified by high-speed copying machines, digital copying machines and full-color copying machines.

The present invention provides a light-receiving member comprising a conductive substrate and a light-receiving layer having a photoconductive layer comprised of non-monocrystalline material and a surface layer which are formed in this order on the conductive substrate, wherein;

the photoconductive layer is comprised of a non-monocrystalline material mainly composed of a silicon atom, containing at least a carbon atom and a hydrogen atom and further optionally containing at least one of an oxygen atom and a nitrogen atom; and carbon atoms having a carbon-carbon bond in the photoconductive layer are in a percentage of not more than 60% based on the whole carbon atoms contained in the photoconductive layer.

The present invention also provides a light-receiving member comprising a conductive substrate and a light-receiving layer having i) a blocking layer comprised of a non-monocrystal, ii) a photoconductive layer and iii) a surface layer which are successively formed on the conductive substrate, wherein;

the blocking layer is comprised of a non-monocrystalline material mainly composed of a silicon atom, containing at least a carbon atom and a hydrogen atom and further containing a boron atom; and carbon atoms in the blocking layer (C/Si+C) are in a content of not less than 3 atom % to not more than 50 atom %, and carbon atoms having a carbon-carbon bond in the blocking layer are in a percentage of not more than 80% based on the whole carbon atoms contained in the blocking layer.

The present invention further provides a light-receiving member comprising a conductive substrate and a light-receiving layer having i) a blocking layer comprised of a non-monocrystal, ii) a photoconductive layer and iii) a surface layer which are successively formed on the conductive substrate, wherein;

the blocking layer is comprised of a non-monocrystalline material mainly composed of a silicon atom, containing at least a carbon atom and a hydrogen atom and further containing at least one of an oxygen atom and a nitrogen atom; and carbon atoms in the blocking layer {C/(Si+C)} are in a content of not less than 3 atom % to not more than 50 atom %, and carbon atoms having a carbon-carbon bond in the blocking layer are in a percentage of not more than 80% based on the whole carbon atoms contained in the blocking layer.

The present invention still further provides a light-receiving member comprising a photoconductive layer having a photoconductivity, wherein;

the photoconductive layer is comprised of a non-monocrystalline material mainly composed of a silicon atom and containing at least a carbon atom and a hydrogen atom; and carbon atoms having a carbon-carbon bond in the photoconductive layer are in a percentage of not more than 60% based on the whole carbon atoms contained in the photoconductive layer.

BRIEF DESCRIPTION OF THE DRAWINGS

FIGS. 3A and 3B are diagrammatic illustrations of a reactor of an apparatus for forming deposited films by microwave plasma CVD method, in which FIG. 3A is a vertical section and FIG. 3B a transverse section.

DETAILED DESCRIPTION OF THE PREFERRED EMBODIMENTS

Figure 1:
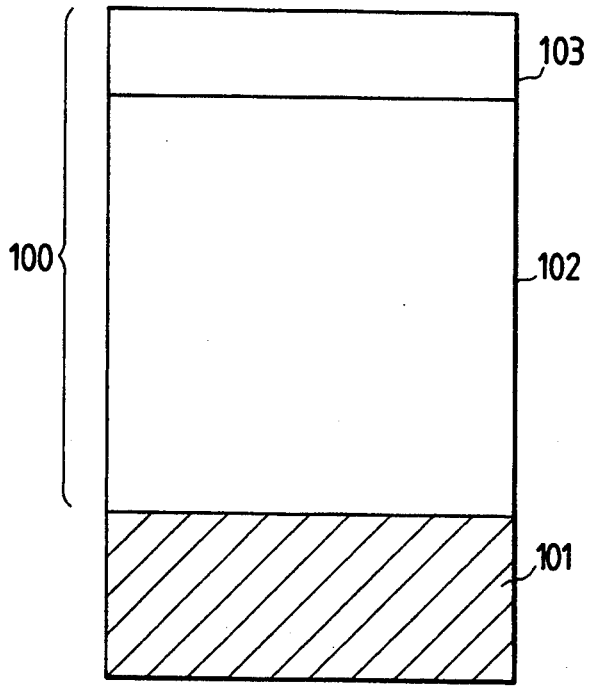
FIG. 1 is a diagrammatic cross section to illustrate an example of the layer structure of the electrophotographic light-receiving member of the present invention.

The light-receiving member of the present invention is based on a finding that, in a light-receiving member comprising a conductive substrate and a light-receiving layer having a photoconductive layer and a surface layer which are formed in this order on said conductive substrate, the photoconductive layer being comprised of a non-monocrystalline material mainly composed of a silicon atom and containing at least a carbon atom and a hydrogen atom, or further containing a boron atom, the percentage of carbon atoms having a carbon-carbon bond in the photoconductive layer, based on the whole carbon atoms contained therein, is closely concerned with the properties required for the photoconductive layer.

More specifically, it has been discovered that all the problems as discussed above, arising from the photoconductive layer, can be solved and very good electrical properties, optical properties, photoconductive properties, image characteristics and durability can be achieved by controlling the percentage of carbon-carbon bonds in the photoconductive layer.

In particular, it has been discovered that, when the above control is accomplished, the residual potential can have substantially no influence on image formation in practical use, the electrical properties can be stable, a high sensitivity and a high SN ratio can be achieved, and images with a high quality, having a high density, showing a clear halftone and having a high resolution can be stably repeatedly obtained because of a superior resistance to fatigue by light, a superior performance in repeated use, a superior moisture resistance and a superior electrical breakdown strength.

It has been also discovered that the electrophotographic light-receiving member in which the above controlling has been made can have a high photoconductivity, can have a speedy response to light and can be free from residual potential or have substantially no problem on it, so that a number of images with a high resolution and a high quality can be repeatedly obtained in a stable state at a high speed and also the light-receiving member can be applied to the formation of images according to digital signals.

The present inventors have also discovered that the percentage of carbon atoms having a carbon-carbon bond in the photoconductive layer, based on the whole carbon atoms contained therein, is very important also in an instance in which the light-receiving layer described above comprises the non-monocrystalline material, which further contains an oxygen atom and/or a nitrogen atom, or further contains a fluorine atom or further contains a boron atom.

In such an instance also, it has been discovered that all the problems as discussed above, arising from the photoconductive layer, can be solved and very good electrical properties, optical properties, photoconductive properties, image characteristics and durability can be achieved by controlling the percentage of carbon-carbon bonds in the photoconductive layer.

Thus, as a result of repeated studies, it has been discovered that the percentage of carbon-carbon bonds in the photoconductive layer is very important for further improving the various properties of the photoconductive layer.

The finding made by the present inventors will be explained below in detail.

Incorporation of carbon atoms into the photoconductive layer can make dielectric constant smaller, and hence can decrease electrostatic capacity per layer thickness to bring about a remarkable improvement in charge performance and photosensitivity. It can also bring about an improvement in breakdown strength against a high voltage and an improvement in durability. In recent years, however, electrophotographic apparatus are sought to achieve higher image quality, higher speed and higher durability. Accordingly, in electrophotographic light-receiving members, there is room for further improvement, as previously stated.

In order to solve the problems previously discussed, the present inventors have made various studies concerning improvement in the layer quality of photoconductive layers. As a result, they have discovered that in a-SiC photoconductive layers the state in which carbon atoms present in the layer are bonded is the key to control of the properties.

In the case when an a-SiC film is used as a photoconductive layer and if the photoconductive layer is formed without any particularity about the state of carbon bonds, silicon atoms and carbon atoms are by no means uniformly distributed to tend to provide a state in which portions with silicon atoms in a large concentration and portions with carbon atoms in a large concentration are mixedly present. In such a film, it is presumed, for example, that carbon atoms are taken in the bonds of silicon atoms in the form of a mass like a cluster. In practice, the bonding of carbon atoms has been analyzed by ESCA (electron spectroscopy for chemical analysis) and FT-IR (Fourier transformation infrared absorption spectroscopy) on conventional a-SiC photoconductive layers to reveal that about 65% of carbon atoms in the whole carbon atoms in a photoconductive layer have bonds between carbon atoms (C—C bonds). This supports the formation of a cluster of carbon atoms in the film of the photoconductive layer.

For the present inventors, what influences the cluster of carbon atoms present in the photoconductive layer is still a matter of conjecture, but can be approximately presumed as follows:

In the first place, the influence of a relatively large cluster can be considered. When an a-SiC photoconductive layer is formed, especially when the carbon content is relatively large, it can be presumed that a relatively large cluster comprising ten or so carbon atoms bonded to each other is formed. This allows a postulation that, if such a large cluster is present in the film, the cluster may inhibit the mobility of carriers moving in the film.

Secondly, an influence on stress in the film because of the presence of a relatively small cluster can be considered. For example, when a relatively small cluster comprising a few or so carbon atom is present, a difference in length between bonding arms of silicon atoms and bonding arms of carbon atoms brings about a stress produced at the bonds between the cluster of carbon atoms and the silicon atoms surrounding it. It can be presumed that the stress thus produced may make the characteristics such as dark resistance of the film poor.

Incidentally, it has been found that the cluster of carbon atoms can be prevented from being formed, changes of internal stress can be relieved, defects in deposited films can be reduced and film quality can be improved when a trace amount (10 to 5,000 atom ppm) of oxygen atoms (O) and/or nitrogen atoms (N) is incorporated into the a-SiC photoconductive layer to more improve the uniformity of deposited films. As a result, it becomes possible to improve what is called temperature characteristics, which concern changes of properties of light-receiving members in accordance with changes of temperature in an environment in which light-receiving members are used. This brings about an improvement in electrophotographic performance such as charge performance. Fluorine atoms (F) may also be incorporated in an amount ranging from 1 to 95 atom ppm. In such a case, it becomes possible to more effectively relieve the stress in a deposited film to prohibit structural defects of the film, on account of the cooperative action of the fluorine atoms and the oxygen atoms (O) and/or nitrogen atoms (N).

From the foregoing consideration, it can be considered indispensable to the improvement of properties to uniformly distribute carbon atoms in silicon atoms particularly in the a-SiC photoconductive layer, i.e., to promote the bonding between silicon atoms and carbon atoms (Si-C bonds) to make C—C bonds as few as possible. Now, the present inventors have controlled the bonding of carbon atoms when the photoconductive layer is formed, to greatly reduce the percentage of carbon atoms having a C—C bond in the whole carbon atoms contained in the photoconductive layer, compared with that in conventional a-SiC photoconductive layers. This has made it possible to form a photoconductive layer that can solve all the problems previously discussed and has superior electrophotographic performance. They have thus accomplished the present invention.

According to the present invention, an improvement of the bonding of component atoms in the photoconductive layer makes it possible to make dark resistance ratio higher while maintaining residual potential at a low level, and hence to obtain an electrophotographic light-receiving member that has a high charge performance and can be almost free from the phenomenon of "ghost". According to the present invention, short-wavelength sensitivity can also be improved compared with that in conventional electrophotographic light-receiving members, and hence spectra of imagewise exposure in electrophotographic apparatus can be kept close to spectra of spectral sensitivity of electrophotographic light-receiving members. This can bring about a great improvement of sensitivity in practical use.

The present inventors have also discovered that, in a light-receiving member comprising a conductive substrate and a light-receiving layer having i) a blocking layer comprised of a non-monocrystal, ii) a photoconductive layer and iii) a surface layer which are successively formed on said conductive substrate, the blocking layer being comprised of a non-monocrystalline material mainly composed of a silicon atom, containing at least a carbon atom and a hydrogen atom and further containing a boron atom, the amount of carbon atoms contained in the blocking layer (C/Si+C) and the percentage of carbon atoms having a carbon-carbon bond in the blocking layer, based on the whole carbon atoms contained therein, are closely concerned with the properties required for the blocking layer, like the case previously described.

More specifically, they have discovered that all the problems as discussed above, arising from the blocking layer, can be solved and very good electrical properties, optical properties, photoconductive properties and image characteristics can be achieved by controlling the percentage of carbon-carbon bonds in the blocking layer.

In particular, they have discovered that, when the above controlling is made, the blocking layer can achieve a high blocking performance and exhibit its performance well without any deleterious influence, can have stable electrical properties and can bring about an improvement in charge performance and dark decay, and images with a high quality, having a high density, showing a clear halftone and having a high resolution can be stably repeatedly obtained.

They have also discovered that the electrophotographic light-receiving member in which the above controlling has been made can have a high photoconductivity, can have a speedy response to light and can be free from residual potential or have substantially no problem on it, so that a number of images with a high resolution and a high quality can be repeatedly obtained in a stable state at a high speed and also the light-receiving member can be applied to the formation of images according to digital signals.

The finding made by the present inventors will be explained below in detail.

As previously stated, incorporation of carbon atoms into the photoconductive layer can make dielectric constant smaller, and hence can decrease electrostatic capacity per layer thickness to bring about a remarkable improvement in charge performance and photosensitivity. It can also bring about an improvement in breakdown strength against a high voltage and an improvement in durability. In order to develop an electrophotographic light-receiving member making the most of these performances and having enhanced a more superiority, the present inventors took note of the blocking layer and have made various studies concerning improvement in the layer quality of blocking layers. As a result, they have discovered that in a-SiC blocking layers the state in which carbon atoms present in the layer are bonded is the key to control of the properties.

In the case when an a-SiC film is used as a blocking layer, it is commonly preferably used with a carbon atom content of 3 to 50 atom % in approximation. Here, if the blocking layer is formed without any particularity about the state of carbon bonds, silicon atoms and carbon atoms are not uniformly distributed tend to provide a state in which portions with silicon atoms in a large concentration and portions with carbon atoms in a large concentration are mixedly present, as in the case of the photoconductive layer. In such a film, it is presumed, for example, that carbon atoms are taken in the bonds of silicon atoms which are in an amorphous state in the form of a mass-like cluster.

In practice, as in the case of a-SiC photoconductive layers, the bonding of carbon atoms has been analyzed by ESCA and FT-IR on conventional a-SiC blocking layers to reveal that about 90% of carbon atoms in the whole carbon atoms in a blocking layer have bonds between carbon atoms (C—C bonds). This supports the formation of a cluster of carbon atoms in the film of the blocking layer.

For the present inventors, what influences the cluster of carbon atoms present in the blocking layer is still a matter of conjecture as in the case of a-SiC photoconductive layers, but the following presumptions can be made:

In the first place, the influence of a relatively large cluster can be considered. When an a-SiC blocking layer is formed, especially when the carbon content is relatively large, it can be presumed that a relatively large cluster comprising ten or so carbon atoms bonded each other is formed. In the blocking layer, boron is incorporated in the film in order to improve blocking performance, where the presence of such a large cluster in the film makes it necessary to incorporate a large quantity of boron in the film in order to achieve the same blocking performance. Hence, it is necessary, for example, to use gas such as diborane in a large quantity when the blocking layer is formed. This presumably results in a lowering of charge performance because of the influence of a residue of boron when the photoconductive layer is formed.

Secondly, an influence on stress in the film because of the presence of a relatively small cluster can be considered. For example, when a relatively small cluster comprising a few or so carbon atoms is present, a difference in length between bonding arms of silicon atoms and bonding arms of carbon atoms brings about a stress produced at the bonds between the cluster of carbon atoms and the silicon atoms surrounding it. It can be presumed that the stress thus produced may make the blocking performance of the film.

From the foregoing consideration, it can be considered indispensable to the improvement of properties to uniformly distribute carbon atoms in silicon atoms particularly in the a-SiC blocking layer, i.e., to promote the bonding between silicon atoms and carbon atoms (Si—S bonds) to make C—C bonds as few as possible. Now, the present inventors have controlled the bonding of carbon atoms when the blocking layer is formed, to greatly reduce the percentage of carbon atoms having a C—C bond in the whole carbon atoms contained in the blocking layer, compared with that in conventional a-SiC blocking layers. This has made it possible to form a blocking layer that can solve all the problems previously discussed and has superior electrophotographic performance. They have thus accomplished the present invention.

The present inventors have also discovered that, also in an instance in which the above blocking layer is comprised of a non-monocrystalline material mainly composed of a silicon atom, containing at least a carbon atom and a hydrogen atom and further containing an oxygen atom and/or a nitrogen atom, the amount of carbon atoms contained in the blocking layer $\{C/(Si+C)\}$ and the percentage of carbon atoms having a carbon-carbon bond in the blocking layer, based on the whole carbon atoms contained therein, are very important. All the problems as discussed above, similarly arising from the blocking layer, can be solved and very good electrical properties, optical properties, photoconductive properties and image characteristics can be achieved by the electrophotographic light-receiving member having the constitution of the present invention as described above.

In particular, they have discovered that, in this instance, the blocking layer can achieve a remarkable improvement in its adhesion to the support and adhesion at the interface between the blocking layer and the photoconductive layer and hence can have superior surface properties, and images with a high quality, causing less faulty images can be stably repeatedly obtained.

They have also discovered that the electrophotographic light-receiving member having the blocking layer composed as described above can have image characteristics excellent in prevention of light-memory such as ghost or blank memory.

In particular, they have discovered that in order to form an electrophotographic photosensitive member with a higher performance it is preferable for the blocking layer to contain oxygen atoms and/or nitrogen atoms in an amount of not less than 10 atom ppm to not more than 50,000 atom ppm.

Namely, the concurrent incorporation of carbon atoms and oxygen atoms and/or nitrogen atoms in the blocking layer makes it possible to obtain a blocking layer with a film quality of a more denseness and a higher adhesion than conventional blocking layers. Hence, not only adhesion to the substrate but also adhesion to the photoconductive layer formed on the blocking layer can be good, bringing about a remarkable decrease in spherical protuberances that are defects of deposited films, which cause faulty images such as "white dots" and "black dots".

Incorporation of oxygen atoms and/or nitrogen atoms in the a-SiC film also makes it possible to more effectively relieve the stress in the deposited film to control structural defects of the film, so that the mobility of carriers in a-SiC can be improved and light-memory such as "blank memory" or "ghost" can be better prevented.

The light-receiving member of the present invention will be described below in greater detail with reference to the accompanying drawings.

FIG. 1 is a diagrammatic cross section to illustrate a preferred example of the layer structure of the electrophotographic light-receiving member of the present invention. An electrophotographic light-receiving member 100 of the present invention comprises a conductive substrate 101 and provided thereon a photoconductive layer 102 and a surface layer 103 which are formed in this order.

The conductive substrate 101 used in the present invention may include those made of, for example, a metal such as Al, Cr, Mo, Au, In, Nb, Te, V, Ti, Pt, Pb or Fe, or an alloy of any of these, as exemplified by stainless steel. It is also possible to use a substrate comprised of a film or sheet of synthetic resin such as polyester, polystyrene, polycarbonate, cellulose acetate, polypropylene, polyvinyl chloride, polyethylene or polyamide or an electrically insulating substrate made of glass or ceramic, the surfaces thereof having been subjected to conductive treatment at least on the side on which the light-receiving layer is formed. In the latter case, the surface should preferably be subjected to conductive treatment also on the side opposite to the side on which the light-receiving layer is formed.

The conductive substrate 101 may have the shape of a cylinder with a smooth plane or uneven surface, or a platelike endless belt. Its thickness may be appropriately so determined that the electrophotographic light-receiving member can be formed as desired. In instances in which the electrophotographic light-receiving member is required to have a flexibility, the substrate may be made as thin as possible so long as it can function well as a substrate. In usual instances, however, the substrate may preferably have a thickness of 10 $\mu$m or more in view of its manufacture and handling, mechanical strength or the like.

In the present invention, in the case when it is necessary for the surface of the conductive substrate 101 to be made uneven, for example, when images are recorded using coherent light such as laser light, the surface of the conductive substrate 101 may be made uneven so that any faulty images due to interference fringes (Moiré fringes) appearing in visible images can be canceled. The unevenness made on the surface of the conductive substrate 101 can be produced by known methods disclosed in Japanese Patent Applications Laid-open No. 60-168156, No. 60-178457, No. 60-225854, etc. As another method for canceling the faulty images due to interference fringes occurring when the coherent light such as laser light is used, the surface of the conductive substrate 101 may be made uneven by making a plurality of sphere-traced concavities on the surface of the conductive substrate 101. More specifically, the surface of the conductive substrate 101 is made more finely uneven than the resolving power required for electrophotographic light-receiving members, and also such uneveness is formed by a plurality of sphere-traced concavities. The unevenness formed by a plurality of sphere-traced concavities on the surface of the conductive substrate 101 can be produced by the known method disclosed in Japanese Patent Application Laid-open No. 61-231561.

The photoconductive layer 102 of the present invention is comprised of a non-monocrystalline material mainly composed of a silicon atom and containing at least a carbon atom and a hydrogen atom, and is so formed that carbon atoms having a C—C bond are in a percentage of not more than 60%, and preferably not more than 30%, based on the whole carbon atoms contained in the photoconductive layer. The photoconductive layer of the present invention can be preferably formed by RF or the like high-frequency plasma CVD method, microwave plasma CVD method or sputtering method. In any of these processes, the reaction must be carried out while controlling the state of bonds in such a way that the percentage of carbon atoms having a C—C bond in the photoconductive layer, based on the whole carbon atoms contained therein, becomes lower than that in conventional a-SiC photoconductive layers.

The photoconductive layer 102 of the present invention may be comprised of a non-monocrystalline material mainly composed of a silicon atom, having at least a carbon atom and a hydrogen atom and also an oxygen atom and/or a nitrogen atom, and further having a fluorine atom, and is so formed that carbon atoms having a C—C bond are in a percentage of not more than 60%, and preferably not more than 30%, based on the whole carbon atoms contained in the photoconductive layer. In this embodiment also, the photoconductive layer can be preferably formed by RF or the like high-frequency plasma CVD method, microwave plasma CVD method or sputtering method. In any of these processes, as described above, the reaction must be carried out while controlling the state of bonds in such a way that the percentage of carbon atoms having a C—C bond in the photoconductive layer, based on the whole carbon atoms contained therein, becomes lower than that in conventional a-SiC photoconductive layers.

For example, in the case when the photoconductive layer 102 of the present invention is formed by RF plasma CVD method or microwave plasma CVD method, starting material gases basically capable of feeding atoms such as silicon atoms and carbon atoms that constitute the photoconductive layer may be introduced, in the desired gaseous state, into a reactor whose inside can be evacuated, and glow discharge may be caused to take place in the reactor to form a layer comprised of a-SiC, on the conductive substrate 101 placed at a predetermined position.

The method for controlling the percentage of carbon atoms having a C—C bond in the photoconductive layer, based on the whole carbon atoms contained therein, can be exemplified by selection of starting material gas species and utilization of ions produced by application of an electric field during discharging.

As a method for controlling the reaction so that the percentage of carbon atoms having a C—C bond in the photoconductive layer, based on the whole carbon atoms contained therein, becomes smaller than that in conventional ones, it is particularly effective to use a starting material gas including silicon atom-containing gases as exemplified by silicon hydrides such as $SiH_4$ and $Si_2H_6$ and silicon fluorides such as $SiF_4$, and together with it a starting material gas for feeding carbon atoms, including gases previously having a silicon atom to carbon atom bond as exemplified by $Si(CH_3)_4$ (tetramethylsilane). As the starting material gas for feeding carbon atoms, $CH_4$, $CF_4$, etc. may also be used together with the above tetramethylsilane.

In the incorporation of oxygen atoms and/or nitrogen atoms into the photoconductive layer, a gas for feeding oxygen atoms may include $O_2$ and $O_3$. It may also include compounds such as CO and $CO_2$ in view of the advantage that not only oxygen atoms but also carbon atoms can be fed. Similarly, in view of the advantage that nitrogen atoms can also be fed, it may also include compounds such as NO, $NO_2$, $N_2O$, $N_2O_3$, $N_2O_4$ and $N_2O_5$. As a starting material gas for feeding fluorine atoms, it may preferably include gaseous or gasifiable fluorine compounds as exemplified by fluorine gas, fluorides, halogen compounds containing fluorine and silane derivatives substituted with fluorine.

In the microwave plasma CVD method, the controlling can be made more greatly effective by applying as an external electrical bias an electric field in the discharging space together with the above method so that ions can effectively reach the substrate surface. This external electrical bias may be a direct-current voltage, a pulsewise voltage, or a pulsating current voltage, which has been rectified by means of a rectifier and varies with time in amplitude. It is also possible to use an alternating-current voltage having a waveform of a sinusoidal wave, a rectangular wave or the like. Suitable voltage of the external electrical bias may be not lower than 15 V to not higher than 300 V, and preferably not lower than 30 V to not higher than 200 V, all as root-mean-square values. It may be appropriately determined in relation to other parameters so that the desired properties of deposited films can be obtained.

In the present invention, it is also effective to use the starting material gas described above, after its dilution with $H_2$ and/or an inert gas such as Ar, He or Ne.

The carbon atoms in the photoconductive layer 102 of the present invention may preferably be in a content of from 3 atom % to 30 atom % based on the silicon atoms. A carbon content of more than 30 atom % is not so preferable since the problem such that the layer has too a high residual potential to be used as the photoconductive layer of electrophotographic light-receiving members may be caused because of optical carriers that can not be readily generated, even when the C—C bonds in the photoconductive layer have been controlled to be less than conventional ones.

If on the other hand the carbon content is less than 3 atom %, it becomes difficult to examine the state of bonds according to the precision achievable by existing analytical equipment and hence it is difficult to clearly distinguish the effect of the present invention.

The carbon atoms may be evenly uniformly contained in the photoconductive layer, or may be contained partly to have such a non-uniform distribution that their content changes in the layer thickness direction of the photoconductive layer. In the case when the content of carbon atoms is changed, the carbon content defined above may preferably be retained at a part where the carbon content is largest. In the region having less carbon atoms, there may be a part having a carbon content smaller than the range defined above.

In this case, even the region where the carbon content is less than 3 atom % is presumed to have the carbon atoms having a C—C bond in a percentage of not more than 60% based on the whole carbon atoms contained in the photoconductive layer, when analyzed by the method previously described.

However, the present invention has been accomplished as a result of the discovery that electrophotographic performances superior to those in conventional cases can be exhibited when the percentage of the carbon atoms having a C—C bond is controlled to be smaller in the photoconductive layer having relatively rich carbon atoms. This effect is remarkably seen in the region having a large carbon content. Hence, even when the carbon content changes to a content less than 3 atom %, the present invention can be well effective if the percentage of the carbon atoms having a C—C bond within the range feasible for analysis is controlled to be no more than 60%, and preferably not more than 30%.

In the present invention, hydrogen atoms must be also contained in the photoconductive layer 102, because they are indispensable for compensating the unbonded arms of silicon atoms, and for improving 10 layer quality, in particular, for improving photoconductivity and charge retention performance. Since particularly when carbon atoms are contained as in the present invention a larger number of hydrogen atoms become necessary for maintaining the layer quality, the quantity of hydrogen contained should be adjusted according to the quantity of carbon contained. Accordingly, the hydrogen atoms may preferably be in a content of from 1 to 40 atom %, more preferably from 5 to 35 atom %, and most preferably from 10 to 30 atom %.

The embodiment in which the photoconductive layer 102 contains oxygen atoms and/or nitrogen atoms can be effective for more effectively relieving the stress in the deposited film to control structural defects of the film and also preventing carbon atoms and hydrogen atom from cohering. Hence, the mobility of carriers in the photoconductive layer can be further improved, resulting in a decrease in potential shift. If the content of oxygen atoms and/or nitrogen atoms is less than 10 atom ppm, it may become impossible to well achieve a further improvement in adhesion of films and the prevention of occurrence of abnormal growth. If it is more than 5,000 atomic ppm, electrical properties necessary to answer an increase in speed of electrophotography may become unsatisfactory. Hence, in the embodiment in which the oxygen atoms and/or nitrogen atoms are incorporated, they should be in a content of from 10 to 5,000 atom ppm. The oxygen atoms and/or nitrogen atoms may be evenly distributed in the photoconductive layer, or may be non-unformly distributed in the layer thickness direction so long as they are distributed in a substantially uniform state in the planes each parallel to the surface.

In addition, the photoconductive layer 102 may also contain fluorine atoms. This can be effective for not only compensating the unbonded arms of silicon atoms but also preventing carbon atoms and hydrogen atoms from cohering. If the fluorine content is less than 1 atom ppm, the intended effect can not be well achieved. If on the other hand it is more than 95 atom ppm, film quality may be lowered inversely. Hence, the fluorine atoms may preferably be in a content of from 1 to 95 atom ppm, more preferably from 3 to 80 atom ppm, and most preferably from 5 to 50 atom ppm. The fluorine atoms may be evenly distributed in the photoconductive layer, or may be non-unformly distributed in the layer thickness direction so long as they are distributed in a substantially uniform state in the planes each parallel to the surface.

In the present invention, the photoconductive layer 102 may preferably contain atoms (M) capable of controlling its conductivity as occasion calls. The atoms capable of controlling the conductivity may be contained in a first region of the photoconductive layer in an evenly uniformly distributed state, or may be contained partly in such a state that they are distributed non-uniformly in the layer thickness direction.

The above atoms capable of controlling the conductivity may include what is called impurities, used in the field of semiconductors, and it is possible to use atoms belonging to Group III in the periodic table (hereinafter "Group III atoms") capable of imparting p-type conductivity or atoms belonging to Group V in the periodic table (hereinafter "Group V atoms") capable of imparting n-type conductivity. The Group III atoms may specifically include boron (B), aluminum (Al), gallium (Ga), indium (In) and thallium (Tl). In particular, B, Al and Ga are preferable. The Group V atoms may specifically include phosphorus (P), arsenic (As), antimony (Sb) and bismuth (Bi). In particular, P and As are preferable.

The atoms (M) capable of controlling the conductivity, contained in the photoconductive layer, may be contained preferably in an amount of from $1\times10^{-3}$ to $5\times10^{4}$ atom ppm, more preferably from $1\times10^{-2}$ to $1\times10^{4}$ atom ppm, and most preferably from $1\times10^{-1}$ to $5\times10^{3}$ atom ppm. In particular, in the case when carbon atoms (C) are contained in the photoconductive layer in an amount not more than $1\times10^{3}$ atom ppm, the atoms (M) contained in the photoconductive layer should preferably be in an amount of from $1\times10^{-3}$ to $1\times10^{3}$ atom ppm. In the case when carbon atoms (C) are contained in an amount more than $1\times10^{3}$ atom ppm, the atoms (M) should preferably in an amount of from $1\times10^{-1}$ to $5\times10^{4}$ atom ppm.

In order to structurally introduce into the photoconductive layer the atoms capable of controlling the conductivity, e.g., Group III atoms or Group IV atoms, a starting material for introducing Group III atoms or a starting material for introducing Group V atoms may be fed, when the layer is formed, into the reactor in a gaseous state together with other gases used to form the photoconductive layer. Those which can be used as the starting material for introducing Group III atoms or starting material for introducing Group V atoms should be selected from those which are gaseous at normal temperature and normal pressure or at least those which can be readily gasified under conditions for the formation of the photoconductive layer. Such a starting material for introducing Group III atoms may specifically include, as a material for introducing boron atoms, boron hydrides such as $B_2H_6$, $B_4H_{10}$, $B_5H_9$, $B_5H_{11}$, $B_6H_{10}$, $B_6H_{12}$ and $B_6H_{14}$, boron halides such as $BF_3$, $BCl_3$ and $BBr_3$. Besides, the material may also include $AlCl_3$, $GaCl_3$, $Ga(CH_3)_3$, $InCl_3$ and $TlCl_3$.

The material that can be effectively used in the present invention as the starting material for introducing Group V atoms may include, as a material for introducing phosphorus atoms, phosphorus hydrides such as $PH_3$ and $P_2H_4$ and phosphorus halides such as $PH_4I$, $PF_3$, $PF_5$, $PCl_3$, $PCl_5$, $PBr_3$, $PBr_5$ and $PI_3$. Besides, the material that can be effectively used as the starting material for introducing Group V atoms may also include $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ and $BiBr_3$.

These starting materials for introducing the atoms capable of controlling the conductivity may be optionally diluted with a gas such as $H_2$, He, Ar or Ne when used.

The photoconductive layer 102 of the present invention may also contain at least one element selected from Group Ia, Group IIa, Group VIb and Group VIII atoms of the periodic table. Any of these elements may be evenly uniformly distributed in the photoconductive layer, or contained partly in such a way that they are evenly contained in the photoconductive layer but are distributed non-uniformly in the layer thickness direction. Any of these atoms should preferably be in a content of from 0.1 to 10,000 atom ppm. The Group Ia atoms may specifically include lithium (Li), sodium (Na) and potassium (K); and the Group IIa atoms, beryllium (Be), magnesium (Mg), calcium (Ca), strontium (Sr) and barium (Ba).

The Group VIb atoms may specifically include chromium (Cr), molybdenum (Mo) and tungsten (W); and the Group VIII atoms, iron (Fe), cobalt (Co) and nickel (Ni).

In the present invention, the thickness of the photoconductive layer 102 may be appropriately determined as desired, taking account of achieving the desired electrophotographic performance and in view of economical effect. The photoconductive layer should preferably be formed in a thickness of from 5 μm to 50 μm, more preferably from 10 μm to 40 μm, most preferably from 15 μm to 30 μm, and still most preferably from 20 μm to 30 μm.

In the light-receiving member of the present invention, it may further have, on the side of the conductive substrate of the photoconductive layer 102, a layer region containing at least aluminum atoms, silicon atoms, carbon atoms and hydrogen atoms in the state they are non-uniformly distributed in the layer thickness direction.

In order to form the a-SiC photoconductive layer 102 that can achieve the object of the present invention, the temperature of the conductive substrate and the gas pressure inside the reactor must be appropriately set as desired.

The temperature (Ts) of the conductive substrate may be appropriately selected from an optimum temperature range in accordance with the layer configuration. In usual instances, the temperature should preferably be in the range of from 20° to 500° C., more preferably from 50° to 480° C., and most preferably from 100° to 450° C.

The gas pressure inside the reactor may also be appropriately selected from an optimum pressure range in accordance with the layer configuration. In usual instances, the pressure may preferably be in the range of from $1\times10^{-5}$ to 100 Torr, preferably from $5\times10^{-5}$ to 30 Torr, and most preferably from $1\times10^{-4}$ to 10 Torr.

In the present invention, preferable numerical values for the conductive substrate temperature and gas pressure necessary to form the photoconductive layer 102 may be in the ranges defined above. In usual instances, these factors for layer formation can not be independently separately determined. Optimum values for the layer formation factors should be determined on the basis of mutual and systematic relationship so that the light-receiving member having the desired properties can be formed.

The photoconductive layer 102 of the light-receiving member according to the present invention can have the properties that solve the problems previously discussed, so long as the percentage of the carbon atoms having a C—C bond in the photoconductive layer, based on the whole carbon atoms contained therein is not more than 60%, and preferably not more than 30%. Thus, needless to say, the formation thereof may be carried out by any methods without limitation to the methods described above.

The surface layer 103 of the present invention is formed of a non-monocrystalline material capable of obtaining the desired properties for the electrophotographic light-receiving member as exemplified by charge retention, environmental resistance and frictional resistance. The surface layer can be formed by a process preferably including RF or the like high-frequency plasma CVD method, microwave plasma CVD method, sputtering method and ion plating method.

For example, when the surface layer 103 comprised of a-SiC is formed by microwave plasma CVD method, a Si-feeding gas basically capable of feeding silicon atoms and a C-feeding gas capable of feeding carbon atoms (C) may be introduced, in the desired gaseous state, into a reactor whose inside can be evacuated, and glow discharge may be caused to take place in the reactor to form a layer comprised of a-SiC, on the conductive substrate 101 placed at a predetermined position.

The material that can serve as the Si-feeding gas used in the present invention may include gaseous or gasifiable silicon hydrides (silanes) such as $SiH_4$, $Si_2H_6$, $Si_3H_8$ and $Si_4H_{10}$, which can be effectively used. In view of readiness in handling for layer formation and Si-feeding efficiency, the material may preferably include $SiH_4$ and $Si_2H_6$. There is no problem in the present invention also when these Si-feeding starting material gases are used optionally after their dilution with a gas such as $H_2$, He, Ar or Ne.

Starting materials that can be effectively used as starting material gases for introducing carbon atoms (C) may include those having C and H as constituent atoms, as exemplified by a saturated hydrocarbon having 1 to 5 carbon atoms, an ethylene type hydrocarbon having 2 to 4 carbon atoms and an acetylene type hydrocarbon having 2 or 3 carbon atoms. Specifically stated, the saturated hydrocarbon can be exemplified by methane ($CH_4$), ethane ($C_2H_6$), propane ($C_3H_8$), n-butane (n-$C_4H_{10}$) and pentane ($C_5H_{12}$); the ethylene type hydrocarbon, ethylene ($C_2H_4$), propylene ($C_3H_6$), butane-1 ($C_4H_8$), butane-2 ($C_4H_8$), isobutylene ($C_4H_8$) and pentene ($C_5H_{10}$); and the acetylene type hydrocarbon, acetylene ($C_2H_2$), methyl acetylene ($C_3H_4$) and butyne ($C_4H_6$). Besides, carbon fluoride compounds such as $CF_4$, $CF_3$, $C_2F_6$, $C_3F_8$ and $C_4F_8$ may also be used as the C-feeding gases of the present invention.

It is also effective for the present invention to use these C-feeding starting material gases optionally after their dilution with a gas such as $H_2$, He, Ar or Ne.

It is still also effective in the present invention to use an alkyl silicide such as $Si(CH_3)_4$ or $Si(C_2H_5)_4$ in combination with the above starting material gases.

The above starting material gases used in the present invention may be fed from independently separate feed sources (bombs). It is also effective in the present invention to use a gas comprised of gases previously mixed in given concentrations.

In the present invention, the thickness of the surface layer 103 should preferably be formed in a thickness of from 0.01 μm to 30 μm, more preferably from 0.05 μm to 20 μm, and most preferably from 0.1 μm to 10 μm, taking account of achieving the desired electrophotographic performance and in view of economical effect.

Conditions for forming the surface layer 103 in the present invention may be appropriately determined so that the desired electrophotographic performance can be obtained. For example, the temperature may be appropriately selected from an optimum temperature range, and should preferably be in the range of from 20° to 500° C., more preferably from 50° to 480° C., and most preferably from 100° to 450° C. The gas pressure inside the reactor may also be appropriately selected from an optimum pressure range, and should preferably be in the range of from $1\times10^{-3}$ to 100 Torr, preferably from $5\times10^{-5}$ to 30 Torr, and most preferably from $1\times10^{-4}$ to 10 Torr.

In the present invention, preferable numerical values for the substrate temperature and gas pressure necessary to form the surface layer 103 may be in the ranges defined above. The conditions can not be independently separately determined. Optimum values should be determined on the basis of mutual and systematic relationship so that the light-receiving member having the desired properties can be formed.

In the method for the formation of the surface layer of the present invention, plasma CVD method carried out at a frequency ranging from 15 MHz to 450 MHz can be effectively used.

In the layer structure of the electrophotographic light-receiving member formed according to the present invention, it is effective to provide, in addition to the photoconductive layer and surface layer described above, an adhesion layer, a lower charge injection blocking layer, etc., having the desired properties. In particular, it is preferable to provide the blocking layer as described later.

A procedure for the method of forming the electrophotographic light-receiving member of the present invention will be described below.

Figure 2:
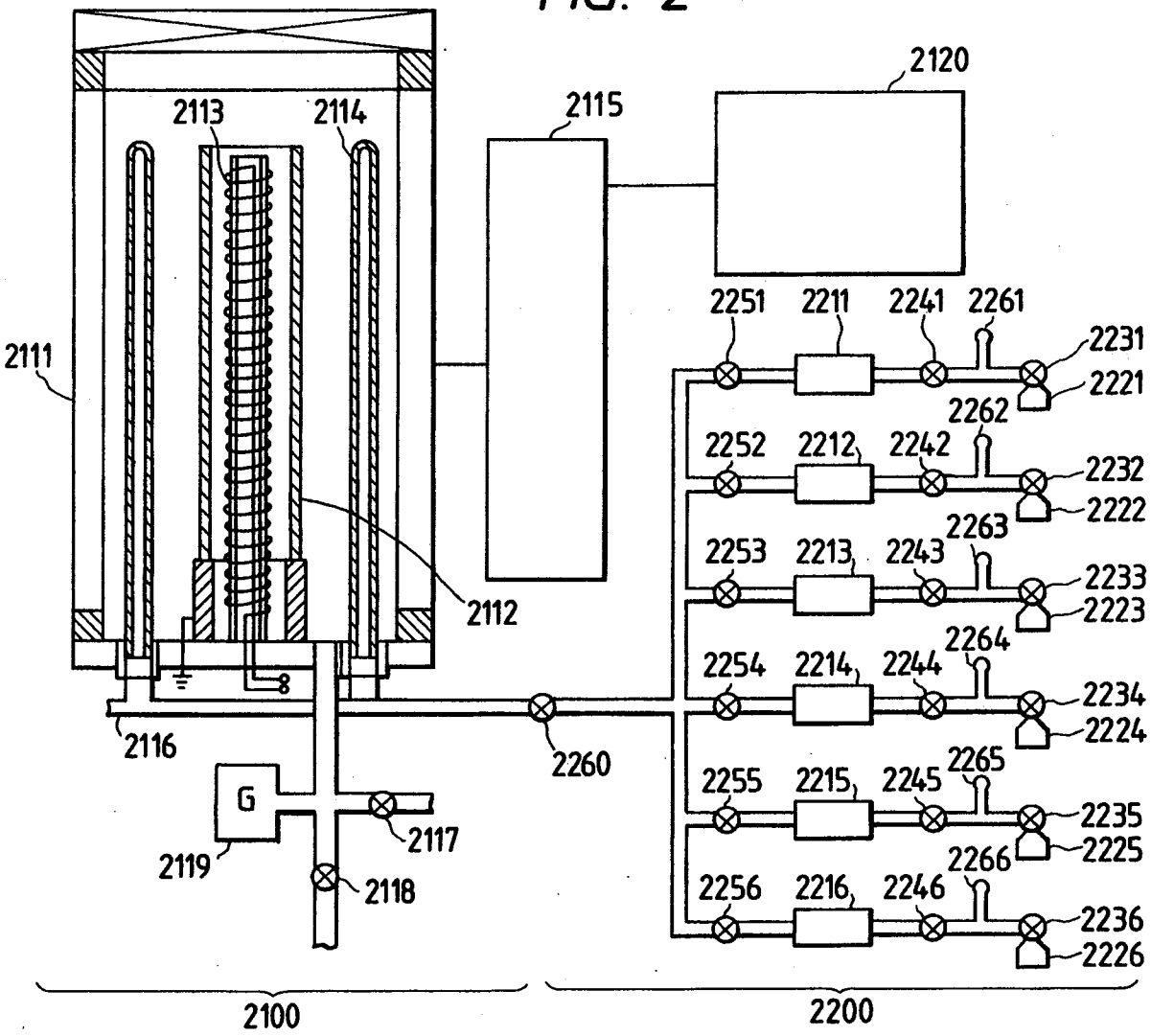
FIG. 2 is a diagrammatic illustration of an example of the whole construction of an apparatus for forming deposited films by high-frequency plasma CVD method.

FIG. 2 diagrammatically illustrates an example of the whole construction of an apparatus for forming deposited films by high-frequency plasma CVD method. A procedure for the formation to the photoconductive layer by the use of this apparatus will be described below.

A cylindrical substrate 2112 is set in a reactor 2111, and the inside of the reactor 2111 is evacuated by means of an evacuation device (not shown) as exemplified by a vacuum pump. Subsequently, the temperature of the substrate 2112 is controlled at a given temperature of from 20° C. to 500° C. by means of a heater 2113 for heating the substrate.

Before starting material gases for forming deposited films are flowed into the reactor 2111, gas bomb valves 2231 to 2236 and a leak valve 2117 of the reactor are checked to make sure that they are closed, and also flow-in valves 2241 to 2246, flow-out valves 2251 to 2256 and an auxiliary valve 2260 are checked to make sure that they are opened. Then, firstly a main valve 2118 is opened to evacuate the insides of the reactor 2111 and a gas pipe 2116.

Next, at the time a vacuum gauge 2119 has been read to indicate a pressure of about $5\times10^{-6}$ Torr, the auxiliary valve 2260 and the flow-out valves 2251 to 2256 are closed.

Thereafter, gas bomb valves 2231 to 2236 are opened so that gases are respectively introduced from gas bombs 2221 to 2226, and each gas is controlled to have a pressure of 2 kg/cm$^2$ by operating pressure controllers 2261 to 2266. Next, the flow-in valves 2241 to 2246 are slowly opened so that gases are respectively introduced into mass flow controllers 2211 to 2216.

After the film formation is thus ready to start, the photoconductive layer and the surface layer are formed on the substrate 2112.

At the time the substrate 2112 has had a given temperature, some necessary flow-out valves 2251 to 2256 and the auxiliary valve 2260 are slowly opened so that given gases are fed into the reactor 2111 from the gas bombs 2221 to 2226 through a gas feed pipe 2114. Next, the mass flow controllers 2211 to 2216 are operated so that each starting material gas is adjusted to flow at a given rate. In that course, the opening of the main valve 2118 is so adjusted that the pressure inside the reactor 2111 comes to be a given pressure of not higher than 1 Torr, while watching the vacuum gauge 2119. At the time the inner pressure has become stable, a high-frequency power source 2120 is set at the desired electric power, and a high-frequency power is supplied to the inside of the reactor 2111 through a high-frequency matching box 2115 to cause glow discharge to take place. The starting material gases fed into the reactor are decomposed by the discharge energy thus produced, so that a given photoconductive layer is formed on the substrate 2112. After a film with a given thickness has been formed, the supply of high-frequency power is stopped, and the flow-out valves are closed to stop gases from flowing into the reactor. The formation of a deposited film is thus completed.

The same operation is repeated plural times, whereby a light-receiving layer with the desired multi-layer structure can be formed.

Needless to say, when the corresponding layers are formed, the flow-out valves other than those for necessary gases are all closed, and the gas species and valve operations are changed according to the conditions under which each layer is formed.

A procedure for the method of forming the electrophotographic light-receiving member of the present invention, using an apparatus for forming deposited films by microwave plasma CVD method will be described below.

Figure 3A:
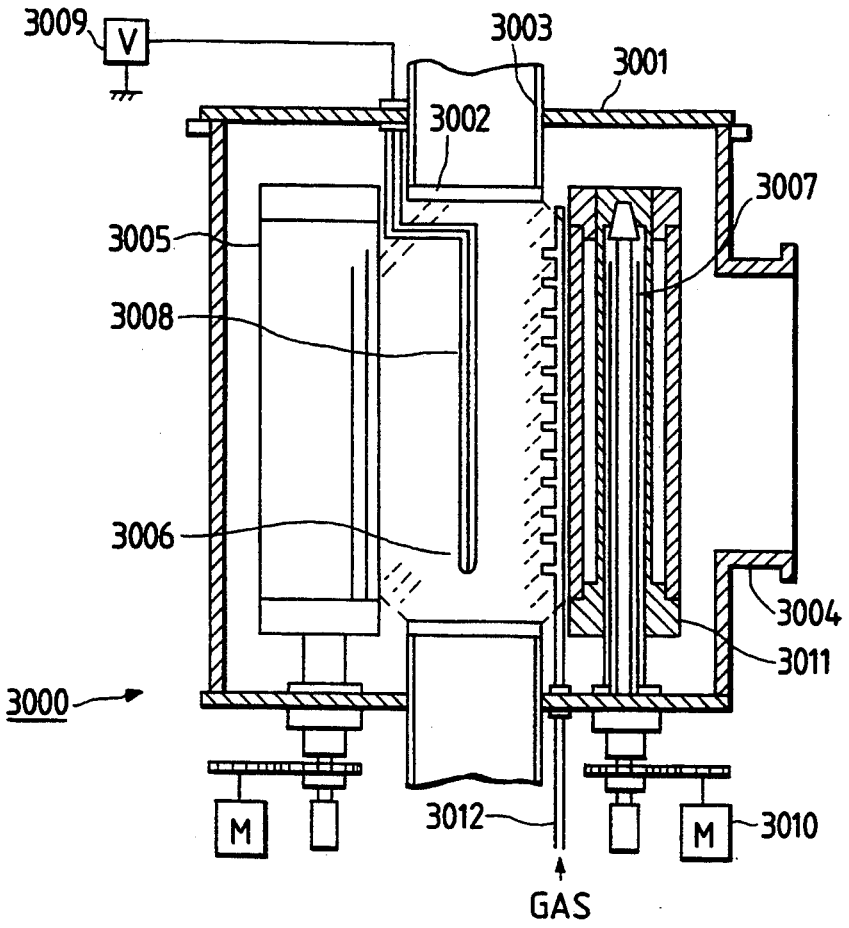
Figure 3B:
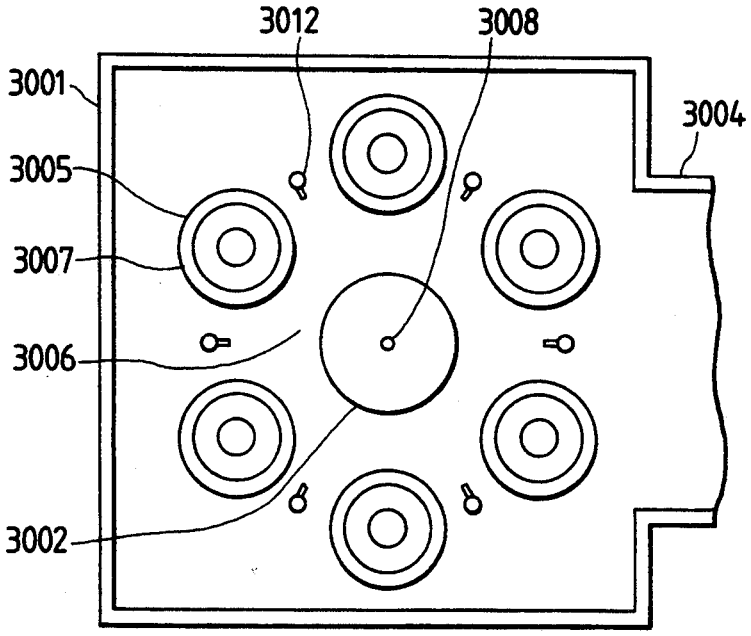
Figure 4:
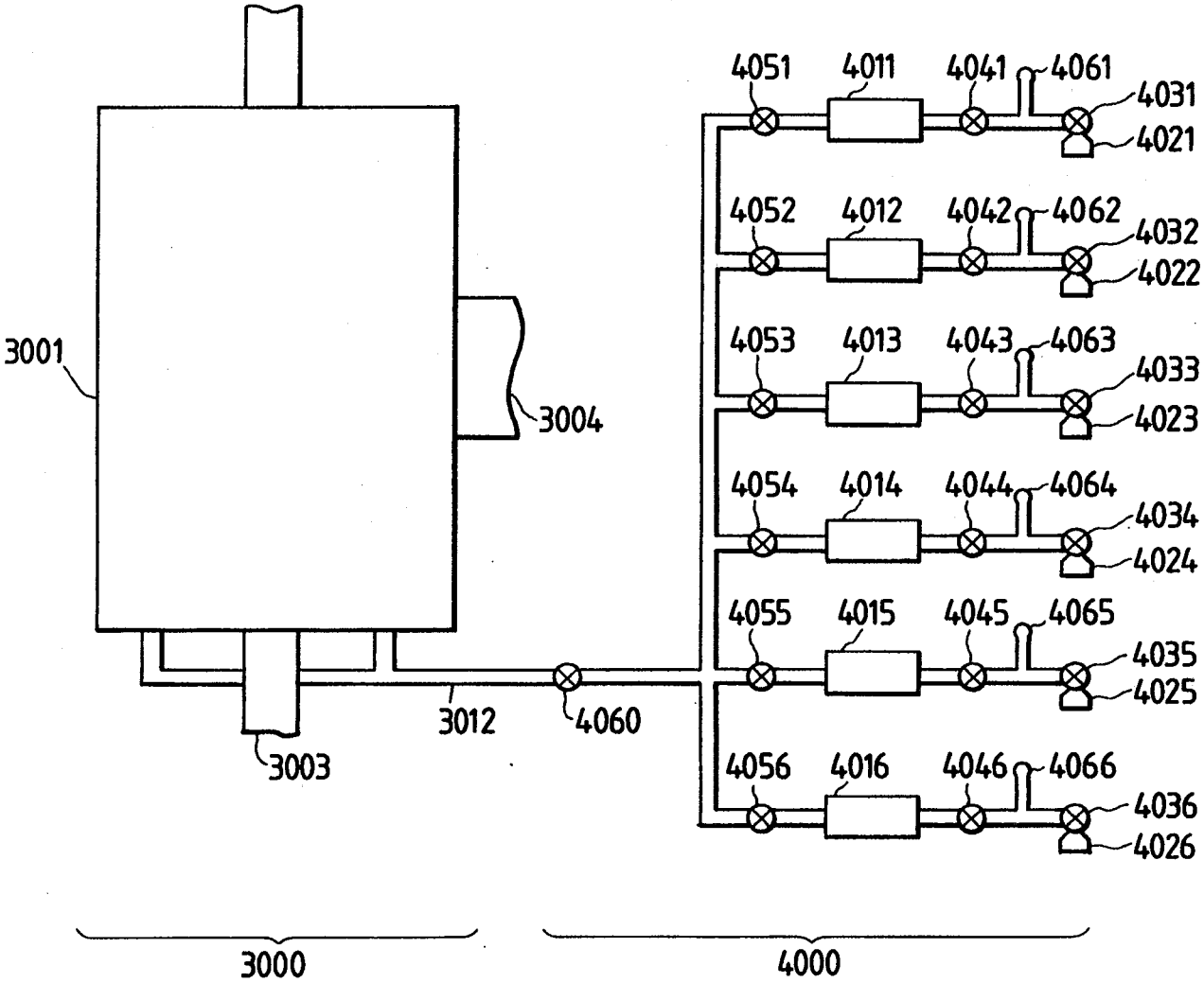
FIG. 4 is a diagrammatic illustration of an example of the whole construction of the apparatus for forming deposited films by microwave plasma CVD method.

FIGS. 3A and 3B diagrammatically illustrate a vertical section and a transverse section, respectively, of a reactor of an apparatus for forming deposited films by microwave plasma CVD method. FIG. 4 diagrammatically illustrates an example of the whole construction of the apparatus.

First, cylindrical conductive substrates 3005 having been degreased and cleaned are set in a reactor 3001.

The conductive substrates 3005 are each rotated by means of a driving mechanism 3010. The inside of the reactor 3001 is evacuated through an exhaust tube 3004 by means of an evacuation device (not shown) as exemplified by a vacuum pump, to control the pressure inside the reactor 3001 to be not higher than $1\times10^{-6}$ Torr. Subsequently, the temperature of the conductive substrate 3005 is controlled at a given temperature of from 20° C. to 500° C. by means of a heater 2113 for heating the substrate.

Before starting material gases for forming the light-receiving member are flowed into the reactor 3001, gas bomb valves 4031 to 4036 and a leak valve (not shown) of the reactor are checked to make sure that they are closed, and also flow-in valves 4041 to 4046, flow-out valves 4051 to 4056 and an auxiliary valve 4060 are checked to make sure that they are opened. Then, firstly a main valve (not shown) is opened to evacuate the insides of the reactor 3001 and a gas pipe 4017.

Next, at the time a vacuum gauge (not shown) has been read to indicate a pressure of about $5\times10^{-6}$ Torr, the auxiliary valve 4060 and the flow-out valves 4051 to 4056 are closed.

Thereafter, gas bomb valves 4031 to 4036 are opened so that gases are respectively introduced from gas bombs 4021 to 4026, and each gas is controlled to have a pressure of 2 kg/cm$^2$ by operating pressure controllers 4061 to 4066. Next, the flow-in valves 4041 to 4046 are slowly opened so that gases are respectively introduced into mass flow controllers 4011 to 4016.

After the film formation is thus ready to start, the photoconductive layer and the surface layer are successively formed on the substrate 3005.

At the time the substrate 3005 has had a given temperature, some necessary flow-out valves 4051 to 4056 and the auxiliary valve 4060 are slowly opened so that given gases are fed into the reactor 3001 from the gas bombs 4021 to 4026 through a gas feed pipe 3012. Next, the mass flow controllers 4011 to 4016 are operated so that each starting material gas is adjusted to flow at a given rate. In that course, the opening of the main valve (not shown) is so adjusted that the pressure inside the reactor 3001 comes to be a given pressure of not higher than 1 Torr, while watching the vacuum gauge (not shown). At the time the inner pressure has become stable, an external electrical bias as exemplified by direct current is applied from a power source 3009 to an electrode 3008 at the desired voltage, and also a microwave power source (not shown) is actuated to generate microwaves with a frequency of, for example, 2.45 GHz. The microwave power source (not shown) is set at the desired electric power, and a microwave energy is supplied to a discharge space 3006 through a microwave guide window 3002 to cause microwave discharge to take place. Thus, a given light-receiving layer is formed on each conductive substrate 3005. At this time, the substrate is rotated at the desired rotational speed by means of the driving means 3010 so that the layer can be uniformly formed.

After a film with a given thickness has been formed on each substrate, the supply of microwave power is stopped, and the flow-out valves are closed to stop gases from flowing into the reactor. The formation of deposited films is thus completed.

The same operation is repeated plural times, whereby light-receiving layers with the desired multi-layer structure can be formed.

Needless to say, when the corresponding layers are formed, the flow-out valves other than those for necessary gases are all closed, and the gas species and valve operations are changed according to the conditions under which each layer is formed.

Figure 5:
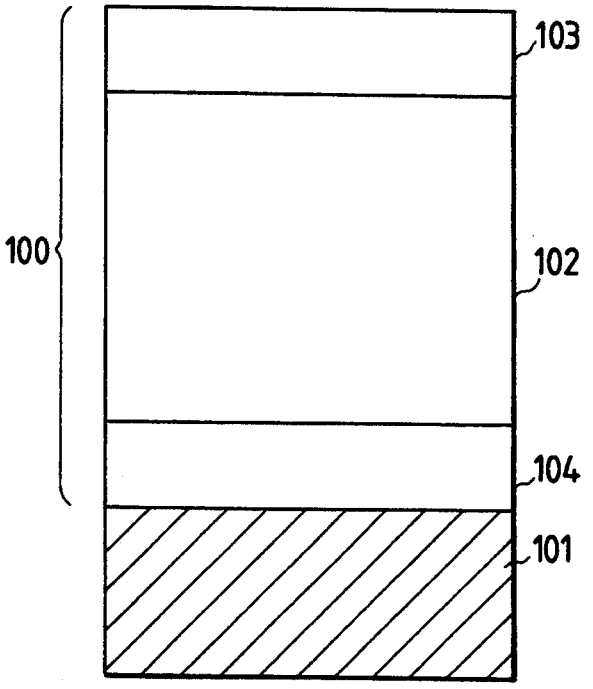
FIG. 5 is a diagrammatic cross section to illustrate another example of the layer structure of the electrophotographic light-receiving member of the present invention.

FIG. 5 is a diagrammatic cross section to illustrate another preferred example of the layer structure of the electrophotographic light-receiving member of the present invention. In this embodiment, an electrophotographic light-receiving member 100 of the present invention comprises a conductive substrate 101 and provided thereon a blocking layer 104, a photoconductive layer 102 and a surface layer 103 which are formed in this order.

The blocking layer 104 of the present invention is comprised of a non-monocrystalline material mainly composed of a silicon atom, containing at least a carbon atom and a hydrogen atom and further containing a boron atom, where carbon atoms contained in the blocking layer (C/Si+C) are in a content of not less than 3 atom % to not more than 50 atom % and carbon atoms having a carbon-carbon bond in the blocking layer are in a percentage of not more than 80%, and preferably not more than 50%, based on the whole carbon atoms contained in the blocking layer.

In another embodiment, the blocking layer 104 of the present invention is comprised of a non-monocrystalline material mainly composed of a silicon atom, containing at least a carbon atom and a hydrogen atom and further containing an oxygen atom and/or a nitrogen atom, where carbon atoms contained in said blocking layer {C/(Si+C)} are in a content of not less than 3 atom % to not more than 50 atom %, and carbon atoms having a carbon-carbon bond in the blocking layer are in a percentage of not more than 80%, and preferably not more than 50%, based on the whole carbon atoms contained in the blocking layer.

The blocking layer of the present invention can be preferably formed by plasma CVD method or sputtering method. In any of these processes, the reaction must be carried out while controlling the state of bonds in such a way that the percentage of carbon atoms having a C—C bond in the blocking layer, based on the whole carbon atoms contained therein, becomes lower than that in conventional a-SiC blocking layers.

For example, in the case when the blocking layer 104 of the present invention is formed by RF plasma CVD method or microwave plasma CVD method, starting material gases basically capable of feeding atoms such as silicon atoms and carbon atoms that constitute the blocking layer may be introduced, in the desired gaseous state, into a reactor whose inside can be evacuated, and glow discharge may be caused to take place in the reactor to form the blocking layer on the conductive substrate 101 placed at a predetermined position.

The method for controlling the percentage of carbon atoms having a C—C bond in the blocking layer, based on the whole carbon atoms contained therein, can be exemplified by selection of starting material gas species and utilization of ions produced by application of an electric field during discharging.

As a method for controlling the reaction so that the percentage of carbon atoms having a C—C bond in the blocking layer, based on the whole carbon atoms contained therein, becomes smaller than that in conventional ones, it is particularly effective to use a starting material gas including silicon atom-containing gases as exemplified by silicon hydrides such as $SiH_4$ and $Si_2H_6$ and silicon fluorides such as $SiF_4$, and together with it a starting material gas for feeding carbon atoms, including gases previously having a silicon atom to carbon atom bond as exemplified by $Si(CH_3)_4$ (tetramethylsilane). As the starting material gas for feeding carbon atoms, $CH_4$, $CF_4$, etc. may also be used together with the above tetramethylsilane.

In a microwave discharge process, the controlling can be made more greatly effective by applying an electric field in the discharging space together with the above method so that ions can effectively reach the substrate surface.

In the present invention, it is also effective to use the starting material gas described above, after its dilution with $H_2$ and/or an inert gas such as Ar, He or Ne.

The carbon atoms in the blocking layer 104 of the present invention may preferably be in a content of from 5 atom % to 50 atom % based on the silicon atoms. If the carbon content is more than 50 atom %, blocking performance may be lowered to lower doping efficiency of boron, resulting in a lowering of electrophotographic performance, e.g., a lowering of charge performance, even when the C—C bonds in the blocking layer have been controlled to be less than conventional ones.

If on the other hand the carbon content is less than 3 atom %, it becomes difficult to examine the state of bonds according to the precision achievable by existing analytical equipment and hence it becomes difficult to clearly distinguish the effect of the present invention.

The carbon atoms may be evenly uniformly contained in the blocking layer, or may be contained partly to have such a non-uniform distribution that their content changes in the layer thickness direction of the blocking layer. In the case when the content of carbon atoms is changed, the carbon content defined above may preferably be retained at a part where the carbon content is largest. In the region having less carbon atoms, there may be a part having a carbon content smaller than the range defined above.

In this case, even the region where the carbon content is small, e.g., the region where it is less than 3 atom %, is presumed to have the carbon atoms having a C—C bond in a percentage of not more than 80% based on the whole carbon atoms contained in the blocking layer, when analyzed by the method previously described. This makes the effect of the present invention unclear as stated above.

However, the present invention has been accomplished as a result of the discovery that electrophotographic performances superior to those in conventional cases can be exhibited when the percentage of the carbon atoms having a C—C bond is controlled to be smaller in the blocking layer having relatively rich carbon atoms. This effect is remarkably seen in the region having a large carbon content. Hence, even when the carbon content changes to a content less than 3 atom %, the present invention can be well effective if the percentage of the carbon atoms having a C—C bond within the range feasible for analysis is controlled to be no more than 80%.

In the present invention, hydrogen atoms must be also contained in the blocking layer 104, because they are indispensable for compensating the unbonded arms of silicon atoms, and for improving layer quality, in particular, for improving photoconductivity and charge retention performance. Since particularly when carbon atoms are contained as in the present invention a larger number of hydrogen atoms become necessary for maintaining the layer quality, the quantity of hydrogen contained should be adjusted according to the quantity of carbon contained. Accordingly, the hydrogen atoms may preferably be in a content of from 1 to 40 atom %, more preferably from 5 to 35 atom %, and most preferably from 10 to 30 atom %.

In the present invention, the blocking layer 104 may preferably contain atoms (M) capable of controlling its conductivity as occasion calls. The atoms capable of controlling the conductivity may be contained in a first region of the blocking layer in an evenly uniformly distributed state, or may be contained partly in such a state that they are distributed non-uniformly in the layer thickness direction.

The above atoms capable of controlling the conductivity may include what is called impurities, used in the field of semiconductors, and it is possible to use atoms belonging to Group III in the periodic table (hereinafter "Group III atoms") capable of imparting p-type conductivity or atoms belonging to Group V in the periodic table (hereinafter "Group V atoms") capable of imparting n-type conductivity. The Group III atoms may specifically include boron (B), aluminum (Al), gallium (Ga), indium (In) and thallium (Tl). In particular, B, Al and Ga are preferable. The Group V atoms may specifically include phosphorus (P), arsenic (As), antimony (Sb) and bismuth (Bi). In particular, P and As-are preferable.

The atoms (M) capable of controlling the conductivity, contained in the blocking layer, may be contained preferably in an amount of from $1\times10^{-3}$ to $5\times10^{4}$ atom ppm, more preferably from $1\times10^{-2}$ to $1\times10^{4}$ atom ppm, and most preferably from $1\times10^{-1}$ to $5\times10^{3}$ atom ppm. In particular, in the case when carbon atoms (C) are contained in the blocking layer in an amount not more than $1\times10^{3}$ atom ppm, the atoms (M) contained in the blocking layer should preferably be in an amount of from $1\times10^{-3}$ to $1\times10^{3}$ atom ppm. In the case when carbon atoms (C) are contained in an amount more than $1\times10^{3}$ atom ppm, the atoms (M) should preferably in an amount of from $1\times10^{-1}$ to $5\times104$ atom ppm.

In order to structurally introduce into the blocking layer the atoms capable of controlling the conductivity, e.g., Group III atoms or Group V atoms, a starting material for introducing Group III atoms or a starting material for introducing Group V atoms may be fed, when the layer is formed, into the reactor in a gaseous state together with other gases used to form the blocking layer. Those which can be used as the starting material for introducing Group III atoms or starting material for introducing Group V atoms should be selected from those which are gaseous at normal temperature and normal pressure or at least those which can be readily gasified under conditions for the formation of the blocking layer. Such a starting material for introducing Group III atoms may specifically include, as a material for introducing boron atoms, boron hydrides such as $B_2H_6$, $B_4H_{10}$, $B_5H_9$, $B_5H_{11}$, $B_6H_{10}$, $B_6H_{12}$ and $B_6H_{14}$, boron halides such as $BF_3$, $BCl_3$ and $BBr_3$. Besides, the material may also include $AlCl_3$, $GaCl_3$, $Ga(CH_3)_3$, $InCl_3$ and $TlCl_3$.

The material that can be effectively used in the present invention as the starting material for introducing Group V atoms may include, as a material for introducing phosphorus atoms, phosphorus hydrides such as $PH_3$ and $P_2H_4$ and phosphorus halides such as $PH_4I$, $PF_3$, $PF_5$, $PCl_3$, $PCl_5$, $PBr_3$, $PBr_5$ and $PI_5$. Besides, the material that can be effectively used as the starting material for introducing Group V atoms may also include $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ and $BiBr_3$.

These starting materials for introducing the atoms capable of controlling the conductivity may be optionally diluted with a gas such as $H_2$, He, Ar or Ne when used.

In the case when the blocking layer 104 contains oxygen atoms and/or nitrogen atoms, an oxygen atom-containing compound serving as a starting material for introducing oxygen atoms may include, for example, oxygen ($O_2$), carbon monoxide (CO) and carbon dioxide ($CO_2$).

A nitrogen atom-containing compound serving as a starting material for introducing nitrogen atoms may include, for example, nitrogen ($N_2$) and ammonia ($NH_3$).

In view of the advantage that not only oxygen atoms can be fed but also nitrogen atoms can be fed simultaneously, the material may include nitrogen monoxide (NO), nitrogen dioxide ($NO_2$), dinitrogen monoxide ($n_2O$), dinitrogen trioxide ($N_2O_3$), dinitrogen tetraoxide ($N_2O_4$) and dinitrogen pentaoxide ($N_2O_5$).

The blocking layer 104 of the present invention may also contain at least one element selected from Group Ia, Group IIa, Group VIb and Group VIII atoms of the periodic table. Any of these elements may be evenly uniformly distributed in the blocking layer, or contained partly in such a way that they are evenly contained in the blocking layer but are distributed non-uniformly in the layer thickness direction. Any of these atoms should preferably be in a content of from 0.1 to 10,000 atom ppm. The Group Ia atoms may specifically include lithium (Li), sodium (Na) and potassium (K); and the Group IIa atoms, beryllium (Be), magnesium (Mg), calcium (Ca), strontium (Sr) and barium (Ba).

The Group VIb atoms may specifically include chromium (Cr), molybdenum (Mo) and tungsten (W); and the Group VIII atoms, iron (Fe), cobalt (Co) and nickel (Ni).

In the present invention, the thickness of the blocking layer may be appropriately determined as desired, taking account of achieving the desired electrophotographic performance and in view of economical effect. It should preferably be in the range of from 0.3 $\mu$m to 10 $\mu$m, more preferably from 0.5 $\mu$m to 5 $\mu$m, and most preferably from 1$\mu$m to 3 $\mu$m.

In the light-receiving member of the present invention, it may further have, on the side of the conductive substrate of the blocking layer 104, a layer region containing at least aluminum atoms, silicon atoms, carbon atoms and hydrogen atoms in the state they are non-uniformly distributed in the layer thickness direction.

In order to form the a-SiC blocking layer 104 that can achieve the object of the present invention, the temperature of the conductive substrate and the gas pressure inside the reactor must be appropriately set as desired.

The temperature (Ts) of the conductive substrate may be appropriately selected from an optimum temperature range in accordance with the layer configuration. In usual instances, the temperature should preferably be in the range of from 20° to 500° C., more preferably from 50° to 480° C., and most preferably from 100° to 450° C.

The gas pressure inside the reactor may also be appropriately selected from an optimum pressure range in accordance with the layer region configuration. In usual instances, the pressure may preferably be in the range of from $1\times10^{-5}$ to 100 Torr, preferably from $5\times10^{-5}$ to 30 Torr, and most preferably from $1\times10^{-4}$ to 10 Torr.

In the present invention, preferable numerical values for the conductive substrate temperature and gas pressure necessary to form the blocking layer 104 may be in the ranges defined above. In usual instances, these factors for layer formation can not be independently separately determined. Optimum values for the layer formation factors should be determined on the basis of mutual and systematic relationship so that the light-receiving member having the desired properties can be formed.

The photoconductive layer 102 of the present invention is formed of a non-monocrystalline material capable of obtaining the desired photoconductivity for the electrophotographic light-receiving member. The photoconductive layer can be formed by a process preferably including RF plasma CVD method, microwave plasma CVD method, sputtering method and ion plating method. In particular, it is preferable to form the photoconductive layer previously described.

An example of the photoconductive layer 102 used in the light-receiving member having the blocking layer described above may include a photoconductive layer 102 comprised of a-SiC. When such a photoconductive layer 102 is formed by plasma CVD method making use of RF or the like, a Si-feeding gas basically capable of feeding silicon atoms and a C-feeding gas capable of feeding carbon atoms (C) may be introduced, in the desired gaseous state, into a reactor whose inside can be evacuated, and glow discharge may be caused to take place in the reactor to form a layer comprised of a-SiC, on the conductive substrate 101 placed at a predetermined position.

The material that can serve as the Si-feeding gas used in the present embodiment may include gaseous or gasifiable silicon hydrides (silanes) such as $SiH_4$, $Si_2H_6$, $Si_3H_8$ and $Si_4H_{10}$, which can be effectively used. In view of readiness in handling for layer formation and Si-feeding efficiency, the material may preferably include $SiH_4$ and $Si_2H_6$. There is no problem in the present invention also when these Si-feeding starting material gases are used optionally after their dilution with a gas such as $H_2$, He, Ar or Ne.

Starting materials that can be effectively used as starting material gases for introducing carbon atoms (C) may include those having C and H as constituent atoms, as exemplified by a saturated hydrocarbon having 1 to 5 carbon atoms, an ethylene type hydrocarbon having 2 to 4 carbon atoms and an acetylene type hydrocarbon having 2 or 3 carbon atoms. Specifically stated, the saturated hydrocarbon can be exemplified by methane ($CH_4$), ethane ($C_2H_6$), propane ($C_3H_8$), n-butane (n-$C_4H_{10}$) and pentane ($C_5H_{12}$); the ethylene type hydrocarbon, ethylene ($C_2H_4$), propylene ($C_3H_6$), butene-1 ($C_4H_8$), butene-2 ($C_4H_8$), isobutylene ($C_4H_8$) and pentene ($C_5H_{10}$); and the acetylene type hydrocarbon, acetylene ($C_2H_2$), methyl acetylene ($C_3H_4$) and butine ($C_4H_6$). Besides, carbon fluoride compounds such as $CF_4$, $CF_3$, $C_2F_6$, $C_3F_8$ and $C_4F_8$ may also be used as the C-feeding gases of the present invention.

It is also effective for the present invention to use these C-feeding starting material gases optionally after their dilution with a gas such as $H_2$, He, Ar or Ne.

It is still also effective in the present invention to use an alkyl silicide such as $Si(CH_3)_4$ or $Si(C_2H_5)_4$ in combination with the above starting material gases, as in the case previous described.

The above starting material gases used in the present invention may be fed from independently separate feed sources (bombs). It is also effective in the present invention to use a gas comprised of gases previously mixed in given concentrations.

In the present embodiment, the thickness of the photoconductive layer 102 should preferably be formed in a thickness of from 10 μm to 50 μm, more preferably from 15 μm to 40 μm, and most preferably from 20 μm to 30 μm, taking account of achieving the desired electrophotographic performance and in view of economical effect.

Conditions for forming the photoconductive layer 102 in the present embodiment may be appropriately determined so that the desired electrophotographic performance can be obtained. For example, the substrate temperature may be appropriately selected from an optimum temperature range, and should preferably be in the range of from 20° to 500° C., more preferably from 50° to 480° C., and most preferably from 100° to 450° C. The gas pressure inside the reactor may also be appropriately selected from an optimum pressure range, and should preferably be in the range of from $1\times10^{-5}$ to 100 Torr, preferably from $5\times10^{-5}$ to 30 Torr, and most preferably from $1\times10^{-4}$ to 10 Torr.

In the present invention, preferable numerical values for the substrate temperature and gas pressure necessary to form the photoconductive layer 102 may be in the ranges defined above. The conditions can not be independently separately determined. Optimum values should be determined on the basis of mutual and systematic relationship so that the light-receiving member having the desired properties can be formed.

In the method for the formation of the photoconductive layer, the plasma CVD method previously described, carried out at a frequency ranging from 15 MHz to 450 MHz can be effectively used.

As the surface layer 103 of the light-receiving member shown in FIG. 5, the surface layer as previously described can be used, and description thereof is omitted here.

A procedure for the method of forming the electrophotographic light-receiving member of the present embodiment will be described below.

FIG. 2 diagrammatically illustrates an example of the whole construction of an apparatus that can be commonly used for forming deposited films by RF plasma CVD method. A procedure for the formation to the photoconductive layer by the use of this apparatus will be described below.

A cylindrical substrate 2112 is set in a reactor 2111, and the inside of the reactor 2111 is evacuated by means of an evacuation device as exemplified by a vacuum pump. Subsequently, the temperature of the substrate 2112 is controlled at a given temperature of from 20° C. to 500° C. by means of a heater 2113 for heating the substrate.

Before starting material gases for forming deposited films are flowed into the reactor 2111, gas bomb valves 2231 to 2236 and a leak valve 2117 of the reactor are checked to make sure that they are closed, and also flow-in valves 2241 to 2246, flow-out valves 2251 to 2256 and an auxiliary valve 2260 are checked to make sure that they are opened. Then, firstly a main valve 2118 is opened to evacuate the insides of the reactor 2111 and a gas pipe 2116.

Next, at the time a vacuum gauge 2119 has been read to indicate a pressure of about $5\times10^{-6}$ Torr, the auxiliary valve 2260 and the flow-out valves 2251 to 2256 are closed.

Thereafter, valves 2231 to 2236 are opened so that gases are respectively introduced from gas bombs 2221 to 2226, and each gas is controlled to have a pressure of 2 kg/cm$^2$ by operating pressure controllers 2261 to 2266. Next, the flow-in valves 2241 to 2246 are slowly opened so that gases are respectively introduced into mass flow controllers 2211 to 2216.

After the film formation is thus ready to start, the blocking layer, the photoconductive layer and the surface layer are formed on the substrate 2112.

At the time the substrate 2112 has had a given temperature, some necessary flow-out valves 2251 to 2256 and the auxiliary valve 2260 are slowly opened so that given gases are fed into the reactor 2111 from the gas bombs 2221 to 2226 through a gas feed pipe 2114. Next, the mass flow controllers 2211 to 2216 are operated so that each starting material gas is adjusted to flow at a given rate. In that course, the opening of the main valve 2118 is so adjusted that the pressure inside the reactor 2111 comes to be a given pressure of not higher than 1 Torr, while watching the vacuum gauge 2119. At the time the inner pressure has become stable, a high-frequency power source 2120 is set at the desired electric power, and a high-frequency power is supplied to the inside of the reactor 2111 through a high-frequency matching box 2115 to cause RF glow discharge to take place. The starting material gases fed into the reactor are decomposed by the discharge energy thus produced, so that a given photoconductive layer is formed on the substrate 2112. After a film with a given thickness has been formed, the supply of RF power is stopped, and the flow-out valves are closed to stop gases from flowing into the reactor. The formation of a layer is thus completed.

Needless to say, when the respective layers are formed, the flow-out valves other than those for necessary gases are all closed, and the gas species and valve operations are changed according to the conditions under which each layer is formed.

In an apparatus for forming deposited films by plasma CVD method making use of VHF and a method for the formation, only the high-frequency power 2115 and the high-frequency matching box 2115 may be replaced with those for VHF.

A procedure for the method of forming the electrophotographic light-receiving member of the present embodiment, using an apparatus for forming deposited films by microwave plasma CVD method will be described below. FIGS. 3A and 3B diagrammatically illustrate a vertical section and a transverse section, respectively, of a reactor of an apparatus for forming deposited films by microwave plasma CVD method. FIG. 4 diagrammatically illustrates an example of the whole construction of the apparatus.

First, cylindrical conductive substrates 3005 having been degreased and cleaned are set in a reactor 3001. The conductive substrates 3005 are each rotated by means of a driving mechanism 3010. The inside of the reactor 3001 is evacuated through an exhaust tube 3004 by means of an evacuation device as exemplified by a vacuum pump, to control the pressure inside the reactor 3001 to be not higher than $1\times10^{-6}$ Torr. Subsequently, the temperature of the cylindrical substrate 3005 is controlled at a given temperature of from 20° C. to 500° C. by means of a heater 2113 for heating the substrate.

Before starting material gases for forming the light-receiving member are flowed into the reactor 3001, gas bomb valves 4031 to 4036 and a leak valve (not shown) of the reactor are checked to make sure that they are closed, and also flow-in valves 4041 to 4046, flow-out valves 4051 to 4056 and an auxiliary valve 4060 are checked to make sure that they are opened. Then, firstly a main valve (not shown) is opened to evacuate the insides of the reactor 3001 and a gas pipe 4017.

Next, at the time a vacuum gauge (not shown) has been read to indicate a pressure of about $5\times10^{-6}$ Torr, the auxiliary valve 4060 and the flow-out valves 4051 to 4056 are closed.

Thereafter, gas bomb valves 4031 to 4036 are opened so that gases are respectively introduced from gas bombs 4021 to 4026, and each gas is controlled to have a pressure of 2 kg/cm$^2$ by operating pressure controllers 4061 to 4066. Next, the flow-in valves 4041 to 4046 are slowly opened so that gases are respectively introduced into mass flow controllers 4011 to 4016.

After the film formation is thus ready to start, the blocking layer, the photoconductive layer and the surface layer are successively formed on the substrate 3005.

At the time the substrate 3005 has had a given temperature, some necessary flow-out valves 4051 to 4056 and the auxiliary valve 4060 are slowly opened so that given gases are fed into the reactor 3001 from the gas bombs 4021 to 4026 through a gas feed pipe 3012. Next, the mass flow controllers 4011 to 4016 are operated so that each starting material gas is adjusted to flow at a given rate. In that course, the opening of the main valve (not shown) is so adjusted that the pressure inside the reactor 3001 comes to be a given pressure of not higher than 1 Torr, while watching the vacuum gauge (not shown). At the time the inner pressure has become stable, a microwave power source (not shown) is actuated to generate microwaves with a frequency of, for example, 2.45 GHz. The microwave power source (not shown) is set at the desired electric power, and a microwave energy is supplied to a discharge space 3006 through a microwave guide window 3002 to cause microwave discharge to take place. Thus, a given light-receiving layer is formed on each conductive substrate 3005. At this time, the substrate is rotated at the desired rotational speed by means of the driving means 3010 so that the layer can be uniformly formed.

After a film with a given thickness has been formed on each substrate, the supply of microwave power is stopped, and the flow-out valves are closed to stop gases from flowing into the reactor. The formation of deposited films is thus completed.

The same operation is repeated plural times, whereby light-receiving layers with the desired multi-layer structure can be formed.

Needless to say, when the corresponding layers are formed, the flow-out valves other than those for necessary gases are all closed, and the gas species and valve operations are changed according to the conditions under which each layer is formed.

EXAMPLES

As specific examples to establish the effect of the present invention, Experiments, Examples and Comparative Examples are respectively set out below. The present invention is by no means limited by these.

Experiment 1

Using as substrates aluminum cylinders having been mirror-finished, degreased and cleaned and using the manufacturing apparatus shown in FIGS. 3A, 3B and 4, electrophotographic light-receiving members (hereinafter called drums) were formed according to the procedure as previously described, under six kinds of preparation conditions 101 to 106 as shown in Table 1. Those treated in the same way but in which only a photoconductive layer was formed on the cylinder (hereinafter called samples) were separately prepared. The drums were each set in an electrophotographic apparatus (NP7550, manufactured by Canon Inc., having been modified for test purpose) and images were formed by a usual electrophotographic process to make evaluation of sensitivity, ghost, charge performance and residual potential.

Evaluation on each item was made in the following way.

Sensitivity

The drum is charged to have a dark portion surface potential of 400 V, and immediately thereafter irradiated with light to form a light image. The light image is formed using a xenon lamp light source, by irradiating the surface with light from which light with a wavelength in the region of 550 nm or less has been removed using a filter. At this time the light portion surface potential of the drum is measured using a surface potentiometer. The amount of exposure is adjusted so as for the light portion surface potential to be at a potential of 50 V, and the amount of exposure used at this time is regarded as the sensitivity.

Ghost

A ghost test chart prepared by Canon Inc. (parts number: FY9-9040) on which a solid black circle with a reflection density of 1.1 and a diameter of 5 mm has been stuck is placed on an original glass plate, and a halftone chart prepared by Canon Inc. is superposed thereon, in the state of which copies are taken. In the copied images thus obtained, the difference seen on the halftone copy, between the reflection density in the black circle with the diameter of 5 mm on the ghost chart and the reflection density of the halftone area is measured to make evaluation.

Charge Performance

The drum is set in the test apparatus, and a high voltage of +6 kV is applied to effect corona charging. The dark portion surface potential of the drum is measured using a surface potentiometer.

Residual Potential

The drum is charged to have a dark portion surface potential of 400 V, and 0.2 second thereafter irradiated with light to form a light image. The light image is formed using a xenon lamp light source, by irradiating the surface with light from which light with a wavelength in the region of 550 nm or less has been removed using a filter. At this time the light portion surface potential of the drum is measured using a surface potentiometer.

The following shows criteria of the evaluation on the above four items.

AA: Particularly good.

A: Good.

B: No problems in practical use.

C: Problematic in practical use.

As for the samples, portions corresponding to the upper and lower portions of image areas were cut out in slices, and quantitative analyses of silicon atoms, carbon atoms and hydrogen atoms contained in films were made by Auger emission spectroscopy, SIMS (secondary ion mass spectroscopy) and organic element spectroscopy as occasion calls. The state of carbon bonds was also analyzed by ESCA and FT-IR.

The results of the evaluation are shown in Table 2, and the results of the analyses in Table 3. As is seen from Tables 1 and 3, the bonding of carbon atoms in the film can be said to be controllable by partly or wholly replacing silane gas and methane gas with tetramethylsilane. As is seen from Tables 2 and 3, properties are improved when the percentage of the carbon atoms having a C—C bond in the photoconductive layer is controlled to be not more than 60% based on the whole carbon atoms contained therein, and also the properties are further improved when the percentage of the carbon atoms having a C—C bond is controlled to be not more than 30%.

Example 1

A drum and a sample were prepared in the same manner as in Experiment 1 except that the flow rate of $Si(CH_3)_4$ serving as a source for feeding carbon atoms to the photoconductive layer was varied to decrease with time and the preparation conditions were changed as shown in Table 4. Evaluation and analyses on the drum and sample thus obtained were made in the same manner as in Experiment 1. The results of evaluation are shown in Table 6, and the results of analyses in Table 7, together with those of Comparative Example 1 shown below.

Comparative Example 1

A drum and a sample were prepared in the same manner as in Experiment 1 except that the flow rate of $Si(CH_3)_4$ serving as a source for feeding carbon atoms to the photoconductive layer was varied to decrease with time, the preparation conditions were changed as shown in Table 5 and the carbon content in the surface, or in the vicinity of the surface, of the photoconductive layer on its side of the substrate was set to be 34.3 atom %. Evaluation and analyses on the drum and sample thus obtained were made in the same manner as in Experiment 1 to obtain the results as shown in Tables 6 and 7.

As is seen from these results, the present invention can be said to be effective also when the photoconductive layer is made to have a gradient in its carbon distribution. It has been also confirmed that the residual potential increases when the carbon content is more than 30 atom % even when the percentage of the carbon atoms having a C—C bond is smaller.

Example 2

A drum and a sample were prepared in the same manner as in Experiment 1 except that films were formed by high-frequency plasma CVD method at a power source frequency of 105 MHz using the manufacturing apparatus shown in FIG. 2 and the preparation conditions were changed as shown in Table 8. Evaluation on the drum thus obtained was made in the same manner as in Experiment 1. As a result, the same good properties as in Experiment 1 were obtained. Analyses on the sample were also made in the same manner as in Experiment 1 to reveal that the carbon content was 12.8 atom %, of which the percentage of the carbon atoms having a C—C bond was 8.3%.

Example 3

A drum and a sample were prepared in the same manner as in Example 2 except that the source for feeding Si atoms to the photoconductive layer was replaced with disilane and the preparation conditions were changed as shown in Table 9. Evaluation on the drum thus obtained was made in the same manner as in Experiment 1. As a result, the same good properties as in Experiment 1 were obtained. Analyses on the sample were also made in the same manner as in Experiment 1 to reveal that the carbon content was 10.5 atom %, of which the percentage of the carbon atoms having a C—C bond was 9.1%.

Example 4

A drum and a sample were prepared in the same manner as in Example 2 except that He was used as a diluent gas and the preparation conditions were changed as shown in Table 10. Evaluation on the drum thus obtained were made in the same manner as in Experiment 1. As a result, the same good properties as in Experiment 1 were obtained. Analyses on the sample were also made in the same manner as in Experiment 1 to reveal that the carbon content was 20.1 atom %, of which the percentage of the carbon atoms having a C—C bond was 12.6%.

Experiment 2

Using as substrates aluminum cylinders having been mirror-finished, degreased and cleaned and using the manufacturing apparatus shown in FIGS. 3A, 3B and 4, electrophotographic light-receiving members (hereinafter called drums) were formed according to the procedure as previously described, under six kinds of preparation conditions 101 to 106 as shown in Table 11. Those treated in the same way but in which only a photoconductive layer was formed on the cylinder (hereinafter called samples) were separately prepared. The drums were each set in an electrophotographic apparatus (NP7550, manufactured by Canon Inc., having been modified for test purpose) and images were formed by a usual electrophotographic process to make evaluation of sensitivity, ghost, charge performance, residual potential and temperature characteristics.

Evaluation on each item was made in the following way.

Sensitivity

The drum is charged to have a dark portion surface potential of 400 V, and immediately thereafter irradiated with light to form a light image. The light image is formed using a xenon lamp light source, by irradiating the surface with light from which light with a wavelength in the region of 550 nm or less has been removed using a filter. At this time the light portion surface potential of the drum is measured using a surface potentiometer. The amount of exposure is adjusted so as for the light portion surface potential to be at a potential of 50 V, and the amount of exposure used at this time is regarded as the sensitivity.

Ghost

A ghost test chart prepared by Canon Inc. (parts number: FY9-9040) on which a solid black circle with a reflection density of 1.1 and a diameter of 5 mm has been stuck is placed on an original glass plate, and a halftone chart prepared by Canon Inc. is superposed thereon, in the state of which copies are taken. In the copied images thus obtained, the difference seen on the halftone copy, between the reflection density in the black circle with the diameter of 5 mm on the ghost chart and the reflection density of the halftone area is measured to make evaluation.

Charge Performance

The drum is set in the test apparatus, and a high voltage of +6 kV is applied to effect corona charging. The dark portion surface potential of the drum is measured using a surface potentiometer.

Residual Potential

The drum is charged to have a dark portion surface potential of 400 V, and 0.2 second thereafter irradiated with light to form a light image. The light image is formed using a xenon lamp light source, by irradiating the surface with light from which light with a wavelength in the region of 550 nm or less has been removed using a filter. At this time the light portion surface potential of the drum is measured using a surface potentiometer.

Temperature Characteristics

The surface temperature of the electrophotographic light-receiving member produced is varied from 30° C. to 45° C., and a high voltage of +6 kV is applied to effect corona charging. The dark portion surface potential thereof is measured using a surface potentiometer. The changes in surface temperature of the dark portion with respect to the surface temperature are approximated in a straight line. The slope thereof is regarded as "temperature characteristics", and shown in unit of "V/deg".

The following shows criteria of the evaluation on the above five items.

AA: Particularly good.

A: Good.

B: No problems in practical use.

C: Problematic in practical use.

As for the samples, portions corresponding to the upper and lower portions of image areas were cut out in slices, and quantitative analyses of silicon atoms, carbon atoms and hydrogen atoms contained in films were made by Auger emission spectroscopy, SIMS and organic element spectroscopy as occasion calls. The state of carbon bonds was also analyzed by ESCA and FT-IR.

The results of the evaluation are shown in Table 12, and the results of the analyses in Table 13. As is seen from Tables 11 and 13, the bonding of carbon atoms in the film can be said to be controllable by partly or wholly replacing silane gas and methane gas with tetramethylsilane. As is seen from Tables 12 and 13, properties are improved when the percentage of the carbon atoms having a C—C bond in the photoconductive layer is controlled to be not more than 60% based on the whole carbon atoms contained therein, and also the properties are further improved when the percentage of the carbon atoms having a C—C bond is controlled to be not more than 30%.

Experiment 3

Drums and samples were prepared in the same manner as in Experiment 2 except that the conditions for preparing the photoconductive layer were changed as shown in Table 14 and the content of oxygen atoms was varied. Evaluation and analyses on the drums and samples thus obtained were made in the same manner as in Experiment 2. The results of evaluation are shown in Table 15, and the results of analyses in Table 16.

As is seen from Tables 15 and 16, it can be said that incorporation of oxygen atoms brings about a decrease in the percentage of the carbon atoms having a C—C bond, so that the temperature characteristics are improved.

Experiment 4

Drums and samples were prepared in the same manner as in Experiment 2 except that the conditions for preparing the photoconductive layer were changed as shown in Table 17 and the content of nitrogen atoms was varied. Evaluation and analyses on the drums and samples thus obtained were made in the same manner as in Experiment 2. The results of evaluation are shown in Table 18, and the results of analyses in Table 19.

As is seen from Tables 18 and 19, it can be said that incorporation of nitrogen atoms brings about a decrease in the percentage of the carbon atoms having a C—C bond, so that the temperature characteristics are improved.

Comparative Example 2

Drums and samples were prepared in the same manner as in Experiment 2 except that the conditions for preparing the photoconductive layer were changed as shown in 401 and 402 in Table 20, and the content of nitrogen atoms was varied. Evaluation and analyses on the drums and samples thus obtained were made in the same manner as in Experiment 2. The results of evaluation are shown in Table 21, and the results of analyses in Table 22.

As is seen from Tables 21 and 22 in comparison with some data of Experiments 2 to 4, it can be said that incorporation of oxygen and nitrogen or fluorine brings about a decrease in the percentage of the carbon atoms having a C—C bond, so that the temperature characteristics are improved.

Example 5

A drum and a sample were prepared in the same manner as in Experiment 1 except that the flow rate of $Si(CH_3)_4$ serving as a source for feeding carbon atoms to the photoconductive layer was varied to decrease with time and the preparation conditions were changed as shown in Table 23. Evaluation and analyses on the drum and sample thus obtained were made in the same manner as in Experiment 2. The results of evaluation are shown in Table 25, and the results of analyses in Table 26, together with those of Comparative Example 3 shown below.

Comparative Example 3

A drum and a sample were prepared in the same manner as in Experiment 1 except that the flow rate of $Si(CH_3)_4$ serving as a source for feeding carbon atoms to the photoconductive layer was varied to decrease with time, the preparation conditions were changed as shown in Table 24 and the carbon content in the surface, or in the vicinity of the surface, of the photoconductive layer on its side of the substrate was set to be 34.3 atom %. Evaluation and analyses on the drum and sample thus obtained were made in the same manner as in Experiment 2 to obtain the results as shown in Tables 25 and 27.

As is seen from these results, the present invention can be said to be effective also when the photoconductive layer is made gradient in its carbon distribution. It has been also confirmed that the residual potential increases when the carbon content is more than 30 atom % even when the percentage of the carbon atoms having a C—C bond is smaller.

Example 6

A drum and a sample were prepared in the same manner as in Experiment 2 except that films were formed by high-frequency plasma CVD method at a power source frequency of 105 MHz using the manufacturing apparatus shown in FIG. 2 and the preparation conditions were changed as shown in Table 27. Evaluation on the drum thus obtained was made in the same manner as in Experiment 2. As a result, the same good properties as in Example 5 were obtained. Analyses on the sample were also made in the same manner as in Experiment 2 to reveal that the carbon content was 12.8 atom %, of which the percentage of the carbon atoms having a C—C bond was 8.3%.

Example 7

A drum and a sample were prepared in the same manner as in Example 6 except that the source for feeding Si atoms to the photoconductive layer was replaced with disilane and the preparation conditions were changed as shown in Table 28. Evaluation on the drum thus obtained was made in the same manner as in Experiment 2. As a result, the same good properties as in Example 5 were obtained. Analyses on the sample were also made in the same manner as in Experiment 2 to reveal that the carbon content was 10.5 atom %, of which the percentage of the carbon atoms having a C—C bond was 9.1%.

Example 8

A drum and a sample were prepared in the same manner as in Example 6 except that He was used as a diluent gas and the preparation conditions were changed as shown in Table 29. Evaluation on the drum thus obtained were made in the same manner as in Experiment 2. As a result, the same good properties as in Example 5 were obtained. Analyses on the sample were also made in the same manner as in Experiment 2 to reveal that the carbon content was 20.1 atom %, of which the percentage of the carbon atoms having a C—C bond was 12.6%.

Experiment 5

Using as substrates aluminum cylinders having been mirror-finished, degreased and cleaned and using the manufacturing apparatus shown in FIGS. 3A and 3B, electrophotographic light-receiving members (hereinafter called drums) in which only the blocking layer was formed (hereinafter called samples) were prepared under four kinds of preparation conditions 101 to 104 as shown in Table 30. Portions corresponding to the upper and lower portions of image areas were cut out in slices, and quantitative analyses of silicon atoms, carbon atoms and hydrogen atoms contained in films were made by Auger emission spectroscopy, SIMS and organic element spectroscopy as occasion calls. The state of carbon bonds was also analyzed by ESCA and FT-IR.

Comparative Experiment

A sample was prepared in the same manner as in Experiment 5 except that $Si(CH_3)_4$ was replaced with $CH_4$ as a source for feeding carbon atoms to the blocking layer and the preparation conditions were changed as shown in Table 30 as Comparative Experiment.

Analyses on these samples thus obtained were made in the same manner as in Experiment 5 to obtain the results as shown in Table 31.

As is seen from Tables 30 and 31, the bonding of carbon atoms in the film can be said to be controllable by partly or wholly replacing silane gas and methane gas with tetramethylsilane. In Experiment 8 carried out under conditions 101 to 104, boron atoms are more efficiently contained in the film. This is presumed to be due to content in less percentage of the carbon atoms having a C—C bond, based on the whole carbon atoms contained in the blocking layer, and more uniform distribution of carbon atoms, than those in Comparative Experiment.

Example 9

Using as substrates the same aluminum cylinder as the one used in Experiment 5 and using the manufacturing apparatus shown in FIGS. 3A and 3B, drums were prepared under preparation conditions shown in Table 32.

The drums thus prepared were set in an electrophotographic apparatus (NP7550, manufactured by Canon Inc., having been modified for test purpose) and images were formed by a usual electrophotographic process to make evaluation of charge performance and dark decay to obtain results as shown in Table 34.

Evaluation on each item was made in the following way.

Charge Performance

The drum is set in the test apparatus, and a high voltage of +6 kV is applied to effect corona charging. The dark portion surface potential of the drum is measured using a surface potentiometer.

Dark Decay

The drum is charged to have a dark portion surface potential of 400 V at the developing position, and dark portion surface potential at the position of an internal sensor on that occasion is measured. Difference in potential with respect to the dark portion surface potential at the developing position is regarded as dark decay.

The following shows criteria of the evaluation on the above two items.

AA: Particularly good.

Good.

B: No problems in practical use.

C: Problematic in practical use.

Comparative Example 4

A drum was prepared under the same conditions as in Example 9 except that the conditions for preparing the blocking layer were changed as shown in Table 33. Evaluation was made in the same manner as in Example 9 to obtain the results as shown in Table 34.

As is seen from Table 34, good results are obtained when in the blocking layer the percentage of the carbon atoms having a C—C bond is not more than 80%. Particularly good results are also obtained when the percentage of the carbon atoms having a C—C bond is not more than 50%.

Example 10

After a blocking layer was formed by high-frequency plasma CVD method at a power source frequency of 105 MHz using the manufacturing apparatus shown in FIG. 2, a drum was prepared under conditions shown in Table 35. Evaluation on the drum thus obtained was made in the same manner as in Example 9 to obtain the results as shown in Table 36.

A sample in which only the blocking layer was formed was prepared, and analyses on the sample were also made in the same manner as in Experiment 5 to reveal that the carbon content in the blocking layer was 22.8 atom %, of which the percentage of the carbon atoms having a C—C bond was 13.3%.

As shown in Table 36, the same good results as in Example 9 were obtained also when films were formed by high-frequency plasma CVD method at a power source frequency of 105 MHz.

Example 11

A drum and a sample were prepared in the same manner as in Example 10 except that the source for feeding Si atoms to the blocking layer was replaced with disilane and the preparation conditions were changed as shown in Table 37. Evaluation on the drum thus obtained was made in the same manner as in Experiment 5. As a result, the same good properties as in Example 9 were obtained. Analyses on the sample were also made in the same manner as in Experiment 5 to reveal that the carbon content in the blocking layer was 15.5 atom %, of which the percentage of the carbon atoms having a C—C bond was 14.1%.

Example 12

A drum and a sample were prepared in the same manner as in Example 10 except that He was used as a diluent gas and the preparation conditions were changed as shown in Table 38. Evaluation on the drum thus obtained were made in the same manner as in Experiment 5. As a result, the same good properties as in Example 9 were obtained. Analyses on the sample were also made in the same manner as in Experiment 5 to reveal that the carbon content in the blocking layer was 25.1 atom %, of which the percentage of the carbon atoms having a C—C bond was 17.6%.

Experiment 6

Using as substrates aluminum cylinders having been mirror-finished, degreased and cleaned and using the manufacturing apparatus shown in FIGS. 3A and 3B, electrophotographic light-receiving members (hereinafter called drums) in which only the blocking layer was formed (hereinafter called samples) were prepared under each four kinds of preparation conditions 101A–101D to 104A–104D as shown in Tables 39-1 to 39-4. Portions corresponding to the upper and lower portions of image areas were cut out in slices, and quantitative analyses of silicon atoms, carbon atoms and hydrogen atoms contained in films were made by Auger emission spectroscopy, SIMS and organic element spectroscopy as occasion calls. The state of carbon bonds was also analyzed by ESCA and FT-IR.

Comparative Experiments

Samples were prepared in the same manner as in Experiment 5 except that $Si(CH_3)_4$ was replaced with $CH_4$ as a source for feeding carbon atoms to the blocking layer and the preparation conditions were changed as shown in Table 39-5 as Comparative Experiment.

Analyses on these samples thus obtained were made in the same manner as in Experiment 6 to obtain the results as shown in Tables 40-1 to 40-5.

As is seen from Tables 39-1 to 39-5 and 40-1 to 40-5, the bonding of carbon atoms in the film can be said to be controllable by partly or wholly replacing silane gas and methane gas with tetramethylsilane.

Example 13

Using as substrates the same aluminum cylinder as the one used in Experiment 6 and using the manufacturing apparatus shown in FIGS. 3A and 3B, drums were prepared under preparation conditions shown in Table 41.

The drums thus prepared were set in an electrophotographic apparatus (NP7550, manufactured by Canon Inc., having been modified for test purpose) and images were formed by a usual electrophotographic process to make evaluation of white dots, black dots, blank memory and ghost to obtain the results shown in Tables 43-1 to 43-4.

Evaluation on each item was made in the following way.

White Dots

A whole-area black chart prepared by Canon Inc. (parts number: FY9-9073) is placed on an original glass plate to take copies. White dots of 0.2 mm or less in diameter, present in the same area of the copied images thus obtained, are counted.

Black Dots

Five or more sheets of transfer paper are superposingly placed on an original glass plate to take copies. Black dots of 0.2 mm or less in diameter, present in the same area of the copied images thus obtained, are counted.

Ghost

A ghost test chart prepared by Canon Inc. (parts number: FY9-9040) on which a solid black circle with a reflection density of 1.1 and a diameter of 5 mm has been stuck is placed on an original glass plate, and a halftone chart prepared by Canon Inc. (parts number: FY9-9042) is superposed thereon, in the state of which copies are taken. In the copied images thus obtained, the difference seen on the halftone copy, between the reflection density in the black circle with the diameter of 5 mm on the ghost chart and the reflection density of the halftone area is measured.

Blank Memory

A halftone chart prepared by Canon Inc (parts number: FY9-9042) is placed on an original glass plate to take copies. On the copied images thus obtained, the difference in reflection density between areas slightly faded in the direction of a mother line and regular areas is measured.

The following shows criteria of the evaluation. on each item.

AA: Particularly good.

A: Good.

B: No problems in practical use.

C. Problematic in practical use.

Comparative Example 5

Drums were prepared under the same conditions as in Example 13 except that the conditions for preparing the blocking layer were changed as shown in Table 42. Evaluation was made in the same manner as in Example 13 to obtain the results as shown in Table 43-5.

As is seen from Tables 43-1 to 43-4, good results are obtained when in the blocking layer the percentage of the carbon atoms having a C—C bond is not more than 80% and the content of oxygen atoms is not less than 10 atom ppm to not less than 5,000 atom ppm based on the whole atoms. Particularly good results are also obtained when the percentage of the carbon atoms having a C—C bond is not more than 50%.

Example 14

After a blocking layer was formed by high-frequency plasma CVD method at a power source frequency of 105 MHz using the manufacturing apparatus shown in FIG. 2, a drum was prepared under conditions shown in Table 44. Evaluation on the drum thus obtained was made in the same manner as in Examples 9 and 13 to obtain the results as shown in Table 47.

A sample in which only the blocking layer was formed was also prepared in the same manner as in Experiment 6, and analyses on the sample were made in the same manner as in Experiment 6 to reveal that the carbon content in the blocking layer was 22.8 atom %, of which the percentage of the carbon atoms having a C—C bond was 13.3%, and the oxygen content was 49.6 atom ppm based on the whole atoms.

As shown in Table 47, the same good results as in Example 13 were obtained also when films were formed by high-frequency plasma CVD method at a power source frequency of 105 MHz.

Example 15

A drum and a sample were prepared in the same manner as in Example 14 except that the source for feeding Si atoms to the blocking layer was replaced with disilane and the preparation conditions were changed as shown in Table 45.

Evaluation on the drum thus obtained was made in the same manner as in Example 13. As a result, the same good properties as in Example 13 were obtained as shown in Table 47.

Analyses on the sample were also made in the same manner as in Experiment 6 to reveal that the carbon content in the blocking layer was 15.5 atom %, of which the percentage of the carbon atoms having a C—C bond was 14.1%, and the oxygen content was 38.9 atom ppm based on the whole atoms.

As shown in Table 47, the same good results as in Example 13 were obtained also when disilane was used as the source for feeding Si atoms to the blocking layer.

Example 16

A drum and a sample were prepared in the same manner as in Example 14 except that He was used as a diluent gas and the preparation conditions were changed as shown in Table 46. Evaluation on the drum thus obtained were made in the same manner as in Example 13. As a result, the same good properties as in Example 13 were obtained. Analyses on the sample were also made in the same manner as in Experiment 6 to reveal that the carbon content in the blocking layer was 25.1 atom %, of which the percentage of the carbon atoms having a C—C bond was 17.6%, and the oxygen content was 41.5 atom ppm based on the whole atoms.

Example 17

A drum was prepared in the same manner as in Example 13 except that the blocking layer was formed under conditions shown in Table 48. Evaluation on the drum thus obtained was made in the same manner as in Example 13.

A sample in which only the blocking layer was formed under conditions shown in Table 48 was also prepared, and analyses on the sample were made in the same manner as in Experiment to reveal that the carbon content in the blocking layer was 24.1 atom %, of which the percentage of the carbon atoms having a C—C bond was 18.1%, and the nitrogen content was 51.0 atom ppm based on the whole atoms.

As a result, as in Example 13, good results were all obtained within the scope of the present invention.

Example 18

A drum was prepared in the same manner as in Example 14 except that the blocking layer was formed under conditions shown in Table 49. Evaluation was similarly made.

A sample in which only the blocking layer was formed under conditions shown in Table 49 was also prepared, and analyses on the sample were made in the same manner as in Experiment to reveal that the carbon content in the blocking layer was 25.8 atom %, of which the percentage of the carbon atoms having a C—C bond was 18.9%, and the nitrogen content was 50.2 atom ppm based on the whole atoms.

As a result, as in Example 14, good results were all obtained within the scope of the present invention.

Example 19

A drum was prepared in the same manner as in Example 15 except that the blocking layer was formed under conditions shown in Table 50. Evaluation was similarly made.

A sample in which only the blocking layer was formed under conditions shown in Table 50 was also prepared, and analyses on the sample were made in the same manner as in Experiment to reveal that the carbon content in the blocking layer was 22.8 atom %, of which the percentage of the carbon atoms having a C—C bond was 18.3%, and the nitrogen content was 52.6 atom ppm based on the whole atoms.

As a result, as in Example 15, good results were all obtained within the scope of the present invention.

Example 20

A drum was prepared in the same manner as in Example 16 except that the blocking layer was formed under conditions shown in Table 51. Evaluation was similarly made.

A sample in which only the blocking layer was formed under conditions shown in Table 51 was also prepared, and analyses on the sample were made in the same manner as in Experiment to reveal that the carbon content in the blocking layer was 20.8 atom %, of which the percentage of the carbon atoms having a C—C bond was 13.3%, and the nitrogen content was 40.6 atom ppm based on the whole atoms.

As a result, as in Example 16, good results were all obtained within the scope of the present invention.

Example 21

A drum was prepared in the same manner as in Example 13 except that the blocking layer was formed under conditions shown in Table 52. Evaluation was similarly made.

A sample in which only the blocking layer was formed under conditions shown in Table 52 was also prepared, and analyses on the sample were made in the same manner as in Experiment to reveal that the carbon content in the blocking layer was 23.6 atom %, of which the percentage of the carbon atoms having a C—C bond was 11.3%, and the total content of oxygen and nitrogen was 98.3 atom ppm based on the whole atoms.

As a result, as in Example 13, good results were all obtained within the scope of the present invention.

Example 22

A drum was prepared in the same manner as in Example 14 except that the blocking layer was formed under conditions shown in Table 53. Evaluation was similarly made.

A sample in which only the blocking layer was formed under conditions shown in Table 53 was also prepared, and analyses on the sample were made in the same manner as in Experiment to reveal that the carbon content in the blocking layer was 25.8 atom %, of which the percentage of the carbon atoms having a C—C bond was 13.5%, and the total content of oxygen and nitrogen was 100.6 atom ppm based on the whole atoms.

As a result, as in Example 14, good results were all obtained within the scope of the present invention.

Example 23

A drum was prepared in the same manner as in Example 15 except that the blocking layer was formed under conditions shown in Table 54. Evaluation was similarly made.

A sample in which only the blocking layer was formed under conditions shown in Table 54 was also prepared, and analyses on the sample were made in the same manner as in Experiment to reveal that the carbon content in the blocking layer was 22.2 atom %, of which the percentage of the carbon atoms having a C—C bond was 14.2%, and the total content of oxygen and nitrogen was 99.6 atom ppm based on the whole atoms.

As a result, as in Example 15, good results were all obtained within the scope of the present invention.

Example 24

A drum was prepared in the same manner as in Example 16 except that the blocking layer was formed under conditions shown in Table 55. Evaluation was similarly made.

A sample in which only the blocking layer was formed under conditions shown in Table 55 was also prepared, and analyses on the sample were made in the same manner as in Experiment to reveal that the carbon content in the blocking layer was 27.8 atom %, of which the percentage of the carbon atoms having a C—C bond was 18.3%, and the total content of oxygen and nitrogen was 89.9 atom ppm based on the whole atoms.

As a result, as in Example 16, good results were all obtained within the scope of the present invention.

Example 25

Drums were prepared in the same manner as in the case when the blocking layer of Example 10 or Example 14 was used, except that the photoconductive layers of Example 1 and Example 5 were respectively used. As a result, the drums prepared in any combination showed very good image characteristics and durability.

As having been described above in detail, the electrophotographic light-receiving member of the present invention can solve the problems involved in conventional electrophotographic light-receiving members on account of the controlling of the percentage of the carbon atoms having a C—C bond in the photoconductive layer, based on the whole carbon atoms contained therein, to be not more than 60%, and preferably not more than 30%.

In other words, according to the present invention, the improvement in the bonding of component atoms in the photoconductive layer makes it possible to make dark resistivity higher while maintaining residual potential at a low level, and hence to obtain an electrophotographic light-receiving member that has a high charge performance and can be almost free from the phenomenon of "ghost". At the same time, short-wavelength sensitivity also is improved compared with that in conventional electrophotographic light-receiving members, and hence spectra of imagewise exposure in electrophotographic apparatus can be kept close to spectra of spectral sensitivity of electrophotographic light-receiving members. This brings about a great improvement of sensitivity in practical use.

In addition to the foregoing, the further incorporation of oxygen atoms and/or nitrogen atoms and fluorine atoms in trace amounts in the photoconductive layer brings about an improvement in what is called temperature characteristics, for which the electrophotographic light-receiving member does not tend to be affected by temperature changes in service environment.

The electrophotographic light-receiving member of the present invention can also solve the problems involved in conventional electrophotographic light-receiving members on account of the controlling of the percentage of the carbon atoms having a C—C bond in the blocking layer, based on the whole carbon atoms contained therein, to be not more than 80%.

In other words, the improvement in the bonding of component atoms in the blocking layer makes it possible to obtain an electrophotographic light-receiving member that has a high charge performance with a small dark decay while maintaining the blocking performance of the blocking layer.

The electrophotographic light-receiving member of the present invention can still also solve the problems involved in conventional electrophotographic light-receiving members on account of the controlling of the percentage of the carbon atoms having a C—C bond in the blocking layer, based on the whole carbon atoms contained therein, and the content of oxygen atoms and/or nitrogen atoms therein.

Moreover, the concurrent incorporation of carbon atoms and oxygen atoms and/or nitrogen atoms in the blocking layer makes it possible to obtain a blocking layer with a film quality of a more denseness and a higher adhesion than conventional blocking layers. Hence, not only adhesion to the substrate but also adhesion to the photoconductive layer formed on the blocking layer can be good, bringing about a remarkable decrease in spherical protuberances that are defects of deposited films, which cause faulty images such as "white dots" and "black dotes".

Furthermore, in the present invention, the incorporation of oxygen atoms and/or nitrogen atoms in the a-SiC film also makes it possible to more effectively relieve the stress in the deposited film to control structural defects of the film, so that the mobility of carriers in a-SiC can be improved and light-memory such as "blank memory" or "ghost" can be better prevented.

TABLE 1

| Conditions: | Photoconductive layer 101 | 102 | 103 | 104 | 105 | 106 | Surface layer |
|---|---|---|---|---|---|---|---|
| Gas flow rate: (sccm) | | | | | | | |
| $SiH_4$ | 350 | 355 | 360 | 365 | 370 | 370 | 200 |
| $CH_4$ | 0 | 30 | 70 | 110 | 150 | 200 | 0 |
| $Si(CH_3)_4$ | 50 | 40 | 30 | 20 | 10 | 0 | 0 |
| $B_2H_6$ (ppm) | 50 | 50 | 50 | 50 | 50 | 50 | 0 |
| $H_2$ | 100 | 120 | 150 | 170 | 190 | 200 | 500 |
| Pressure: (mTorr) | 10 | 10 | 10 | 10 | 10 | 10 | 10 |
| Microwave power: (W) | 1000 | 1000 | 1000 | 1000 | 1000 | 1000 | 1000 |
| Bias voltage: (V) | 100 | 100 | 100 | 100 | 100 | 100 | 100 |
| Layer thickness: (μm) | 25 | 25 | 25 | 25 | 25 | 25 | 0.5 |

TABLE 2

| | 101 | 102 | 103 | 104 | 105 | 106 |
|---|---|---|---|---|---|---|
| Sensitivity: | AA | AA | AA | AA | A | A |
| Ghost: | AA | AA | AA | A | A | B |
| Charge performance: | AA | AA | A | A | AA | AA |
| Residual potential: | AA | AA | AA | A | A | B |

TABLE 3

| Elements | 101 | 102 | 103 | 104 | 105 | 106 |
|---|---|---|---|---|---|---|
| | Compositional ratio (at. %) | | | | | |
| Si (total) | 68.9 | 67.7 | 63.1 | 64.5 | 62.3 | 62.3 |
| H (total) | 14.6 | 15.4 | 18.7 | 15.6 | 20.1 | 17.1 |
| C (total) | 16.5 | 17.2 | 18.2 | 19.8 | 17.6 | 20.6 |
| C (C—C) | 2.2 | 2.8 | 5.1 | 7.8 | 9.3 | 14.1 |
| | C (C—C)/C (total) (%) | | | | | |
| | 13.3 | 16.2 | 28.0 | 39.4 | 52.8 | 68.4 |

C (C—C): Compositional ratio of carbon atoms having a C—C bond.

TABLE 4

| Conditions | Layer structure: Photoconductive layer | Surface layer |
|---|---|---|
| Gas flow rate: (sccm) | | |
| $SiH_4$ | 370 | 200 |
| $CH_4$ | 0 | 0 |
| $Si(CH_3)_4$ | 90 → 0 | 0 |
| $B_2H_6$ (ppm) | 50 | 0 |
| $H_2$ | 200 | 500 |
| Pressure: (mTorr) | 10 | 10 |
| Microwave power: (W) | 1,000 | 1,000 |
| Bias voltage: (V) | 100 | 100 |
| Layer thickness: (μm) | 25 | 0.5 |

TABLE 5

| Conditions | Layer structure: Photoconductive layer | Surface layer |
|---|---|---|
| Gas flow rate: (sccm) | | |
| $SiH_4$ | 100 | 200 |
| $CH_4$ | 0 | 0 |
| $Si(CH_3)_4$ | 400 → 0 | 0 |
| $B_2H_6$ (ppm) | 50 | 0 |
| $H_2$ | 200 | 500 |
| Pressure: (mTorr) | 10 | 10 |
| Microwave power: | 1,000 | 1,000 |

TABLE 5-continued

| Conditions | Layer structure: Photoconductive layer | Surface layer |
|---|---|---|
| (W) | | |
| Bias voltage: (V) | 100 | 100 |
| Layer thickness: (μm) | 25 | 0.5 |

TABLE 6

| | Example 1 | Comparative Example 1 |
|---|---|---|
| Sensitivity: | AA | A |
| Ghost: | AA | A |
| Charge performance: | AA | AA |
| Residual potential: | AA | B |

TABLE 7

| Elements | Compositional ratio (at. %): Example 1 | Comparative Example 1 |
|---|---|---|
| Si (total) | 65.2 → 69.5 | 52.6 → 68.8 |
| H (total) | 16.5 → 30.5 | 13.1 → 31.2 |
| C (total) | 18.3 → 0 | 34.3 → 0 |
| C (C—C) | 2.2 → 0 | 5.5 → 0 |

C (C—C): Compositional ratio of carbon atoms having a C—C bond.

TABLE 8

| Conditions | Layer structure: Photoconductive layer | Surface layer |
|---|---|---|
| Gas flow rate: (sccm) | | |
| $SiH_4$ | 500 | 200 |
| $CH_4$ | 0 | 450 |
| $Si(CH_3)_4$ | 100 | 0 |
| $B_2H_6$ (ppm) | 70 | 0 |
| $H_2$ | 500 | 500 |
| Pressure: (mTorr) | 50 | 50 |
| High-frequency power: (W) | 500 | 500 |
| Layer thickness: (μm) | 25 | 0.5 |

TABLE 9

| Conditions | Layer structure: Photoconductive layer | Surface layer |
|---|---|---|
| Gas flow rate: (sccm) | | |
| $SiH_4$ | 0 | 200 |
| $Si(CH_3)_4$ | 300 | 0 |
| $CH_4$ | 0 | 450 |
| $Si_2H_6$ | 100 | 0 |
| $B_2H_6$ (ppm) | 70 | 0 |
| $H_2$ | 500 | 500 |
| Pressure: (mTorr) | 50 | 50 |
| High-frequency power: (W) | 500 | 500 |
| Layer thickness: (μm) | 25 | 0.5 |

TABLE 10

| Conditions | Layer structure: Photoconductive layer | Surface layer |
|---|---|---|
| Gas flow rate: (sccm) | | |
| $SiH_4$ | 500 | 200 |

TABLE 10-continued

| Conditions | Layer structure: Photoconductive layer | Layer structure: Surface layer |
|---|---|---|
| $CH_4$ | 0 | 450 |
| $Si(CH_3)_4$ | 100 | 0 |
| $B_2H_6$ (ppm) | 70 | 0 |
| He | 500 | 500 |
| Pressure: (mTorr) | 50 | 50 |
| High-frequency power: (W) | 500 | 500 |
| Layer thickness: (μm) | 25 | 0.5 |

TABLE 11

| Conditions: | Photoconductive layer 101 | 102 | 103 | 104 | 105 | 106 | Surface layer |
|---|---|---|---|---|---|---|---|
| Gas flow rate: (sccm) | | | | | | | |
| $SiH_4$ | 350 | 355 | 360 | 365 | 370 | 370 | 200 |
| $CH_4$ | 0 | 30 | 70 | 110 | 150 | 200 | 450 |
| $Si(CH_3)_4$ | 50 | 40 | 30 | 20 | 10 | 0 | 0 |
| $CO_2$ (ppm)* | 500 | 500 | 500 | 500 | 500 | 500 | 0 |
| $NH_3$ (ppm)* | 500 | 500 | 500 | 500 | 500 | 500 | 0 |
| $SiF_4$ (ppm)* | 50 | 50 | 50 | 50 | 50 | 50 | 0 |
| $B_2H_6$ (ppm)* | 50 | 50 | 50 | 50 | 50 | 50 | 0 |
| $H_2$ | 100 | 120 | 150 | 170 | 190 | 200 | 500 |
| Pressure: (mTorr) | 10 | 10 | 10 | 10 | 10 | 10 | 10 |
| Microwave power: (W) | 1000 | 1000 | 1000 | 1000 | 1000 | 1000 | 1000 |
| Bias voltage: (V) | 100 | 100 | 100 | 100 | 100 | 100 | 100 |
| Layer thickness: (μm) | 25 | 25 | 25 | 25 | 25 | 25 | 0.5 |

*(based on $SiH_4$)

TABLE 12

| | 101 | 102 | 103 | 104 | 105 | 106 |
|---|---|---|---|---|---|---|
| Sensitivity: | AA | AA | AA | AA | A | A |
| Ghost: | AA | AA | AA | A | A | B |
| Charge performance: | AA | AA | A | A | AA | AA |
| Residual potential: | AA | AA | AA | A | A | B |
| Temperature characteristics: | AA | AA | A | A | B | B |

TABLE 13

| Elements | 101 | 102 | 103 | 104 | 105 | 106 |
|---|---|---|---|---|---|---|
| | Compositional ratio (at. %) | | | | | |
| Si (total) | 68.5 | 66.4 | 61.9 | 63.2 | 62.5 | 62.0 |
| H (total) | 14.7 | 15.7 | 20.3 | 16.6 | 21.1 | 17.5 |
| C (total) | 16.8 | 17.9 | 17.8 | 20.2 | 16.4 | 20.5 |
| C (C—C) | 2.0 | 2.6 | 4.8 | 7.5 | 8.3 | 13.5 |
| | C (C—C)/C (total) (%) | | | | | |
| | 11.9 | 14.5 | 27.0 | 37.1 | 50.6 | 65.9 |

C (C—C): Compositional ratio of carbon atoms having a C—C bond.

TABLE 14

| Conditions: | Photoconductive layer 201 | 202 | 203 | 204 | 205 | Surface layer |
|---|---|---|---|---|---|---|
| Gas flow rate: (sccm) | | | | | | |
| $SiH_4$ | 350 | 350 | 350 | 350 | 350 | 200 |
| $CH_4$ | 0 | 0 | 0 | 0 | 0 | 450 |
| $Si(CH_3)_4$ | 50 | 50 | 50 | 50 | 50 | 0 |
| $CO_2$ (ppm)* | 5 | 50 | $5 \times 10^2$ | $5 \times 10^2$ | $5 \times 10^4$ | 0 |
| $B_2H_6$ (ppm)* | 50 | 50 | 50 | 50 | 50 | 0 |
| $H_2$ | 100 | 100 | 100 | 100 | 100 | 500 |

TABLE 14-continued

| Conditions: | Photoconductive layer 201 | 202 | 203 | 204 | 205 | Surface layer |
|---|---|---|---|---|---|---|
| Pressure: (mTorr) | 10 | 10 | 10 | 10 | 10 | 10 |
| Microwave power: (W) | 1000 | 1000 | 1000 | 1000 | 1000 | 1000 |
| Bias voltage: (V) | 100 | 100 | 100 | 100 | 100 | 100 |
| Layer thickness: (μm) | 25 | 25 | 25 | 25 | 25 | 0.5 |

*(based on $SiH_4$)

TABLE 15

| | 201 | 202 | 203 | 204 | 205 |
|---|---|---|---|---|---|
| Sensitivity: | AA | AA | AA | AA | AA |
| Ghost: | AA | AA | AA | AA | AA |
| Charge performance: | AA | AA | AA | AA | AA |
| Residual potential: | AA | AA | AA | AA | AA |
| Temperature characteristics: | B | A | A | A | B |

TABLE 16

| Elements | 201 | 202 | 203 | 204 | 205 |
|---|---|---|---|---|---|
| | Compositional ratio (at. %) | | | | |
| Si (total) | 69.1 | 68.6 | 68.1 | 67.5 | 68.7 |
| H (total) | 14.0 | 14.9 | 15.1 | 16.0 | 15.1 |
| C (total) | 16.9 | 16.5 | 16.8 | 16.5 | 16.2 |
| C (C—C) | 2.6 | 2.3 | 2.1 | 2.2 | 2.0 |
| | Compositional ratio (at. ppm) | | | | |
| O (total) | 2.3 | 46.2 | 602 | 3,230 | 10,200 |
| | C (C—C)/C (total) (%) | | | | |
| | 15.4 | 13.9 | 12.5 | 13.3 | 12.3 |

C (C—C): Compositional ratio of carbon atoms having a C—C bond.

TABLE 17

| Conditions: | Photoconductive layer 301 | 302 | 303 | 304 | 305 | Surface layer |
|---|---|---|---|---|---|---|
| Gas flow rate: (sccm) | | | | | | |
| $SiH_4$ | 350 | 350 | 350 | 350 | 350 | 200 |
| $CH_4$ | 0 | 0 | 0 | 0 | 0 | 450 |
| $Si(CH_3)_4$ | 50 | 50 | 50 | 50 | 50 | 0 |
| $NH_3$ (ppm)* | 5 | 50 | $5 \times 10^2$ | $5 \times 10^2$ | $5 \times 10^4$ | 0 |
| $B_2H_6$ (ppm)* | 50 | 50 | 50 | 50 | 50 | 0 |
| $H_2$ | 100 | 100 | 100 | 100 | 100 | 500 |
| Pressure: (mTorr) | 10 | 10 | 10 | 10 | 10 | 10 |
| Microwave power: (W) | 1000 | 1000 | 1000 | 1000 | 1000 | 1000 |
| Bias voltage: (V) | 100 | 100 | 100 | 100 | 100 | 100 |
| Layer thickness: (μm) | 25 | 25 | 25 | 25 | 25 | 0.5 |

*(based on $SiH_4$)

TABLE 18

| | 301 | 302 | 303 | 304 | 305 |
|---|---|---|---|---|---|
| Sensitivity: | AA | AA | AA | AA | AA |
| Ghost: | AA | AA | AA | AA | AA |
| Charge performance: | AA | AA | AA | AA | AA |
| Residual potential: | AA | AA | AA | AA | AA |
| Temperature characteristics: | B | A | A | A | B |

TABLE 19

| Elements | 301 | 302 | 303 | 304 | 305 |
|---|---|---|---|---|---|
| | Compositional ratio (at. %) | | | | |

TABLE 19-continued

| Elements | 301 | 302 | 303 | 304 | 305 |
|---|---|---|---|---|---|
| Si (total) | 68.7 | 68.1 | 68.5 | 67.8 | 67.9 |
| H (total) | 14.8 | 13.8 | 14.1 | 15.4 | 15.8 |
| C (total) | 16.5 | 17.1 | 17.4 | 16.8 | 16.3 |
| C (C—C) | 2.6 | 2.4 | 2.3 | 2.1 | 2.0 |
| | Compositional ratio (at. ppm) | | | | |
| N (total) | 5.1 | 62.4 | 912 | 4,110 | 17,300 |
| | C (C—C)/C (total) (%) | | | | |
| | 15.8 | 14.0 | 13.2 | 12.5 | 12.3 |

C (C—C): Compositional ratio of carbon atoms having a C—C bond.

TABLE 20

| Conditions: | Photoconductive layer 101 Exp. 2 | 203 Exp. 3 | 303 Exp 3 | 401 Comp. Ex. 2 | 402 | Surface layer |
|---|---|---|---|---|---|---|
| Gas flow rate: (sccm) | | | | | | |
| $SiH_4$ | 350 | 350 | 350 | 350 | 350 | 200 |
| $CH_4$ | 0 | 0 | 0 | 0 | 0 | 450 |
| $Si(CH_3)_4$ | 50 | 50 | 50 | 50 | 50 | 0 |
| $CO_2$ (ppm)* | 500 | 500 | 0 | 0 | 0 | 0 |
| $NH_2$ (ppm)* | 500 | 0 | 500 | 0 | 0 | 0 |
| $SiF_4$ (ppm)* | 50 | 0 | 0 | 50 | 0 | 0 |
| $B_2H_6$ (ppm)* | 50 | 50 | 50 | 50 | 50 | 0 |
| $H_2$ | 100 | 100 | 100 | 100 | 100 | 500 |
| Pressure: (mTorr) | 10 | 10 | 10 | 10 | 10 | 10 |
| Microwave power: (W) | 1000 | 1000 | 1000 | 1000 | 1000 | 1000 |
| Bias voltage: (V) | 100 | 100 | 100 | 100 | 100 | 100 |
| Layer thickness: (μm) | 25 | 25 | 25 | 25 | 25 | 0.5 |

*(based on $SiH_4$)

TABLE 21

| | 101 | 203 | 303 | 401 | 402 |
|---|---|---|---|---|---|
| Sensitivity: | AA | AA | AA | AA | AA |
| Ghost: | AA | AA | AA | AA | AA |
| Charge performance: | AA | AA | AA | AA | AA |
| Residual potential: | AA | AA | AA | AA | AA |
| Temperature characteristics: | AA | A | A | A | B |

TABLE 22

| Elements | 101 | 202 | 303 | 401 | 402 |
|---|---|---|---|---|---|
| | Compositional ratio (at. %) | | | | |
| Si (total) | 68.5 | 68.1 | 68.5 | 67.8 | 68.9 |
| H (total) | 14.7 | 15.1 | 14.1 | 15.5 | 14.6 |
| C (total) | 16.8 | 16.8 | 17.4 | 16.7 | 16.5 |
| C (C—C) | 2.0 | 2.1 | 2.3 | 2.2 | 2.2 |
| | Compositional ratio (at. ppm) | | | | |
| O (total) | 560 | 602 | 0 | 0 | 0 |
| N (total) | 881 | 0 | 912 | 0 | 0 |
| F (total) | 46 | 0 | 0 | 55 | 0 |
| | C (C—C)/C (total) (%) | | | | |
| | 11.9 | 12.5 | 13.2 | 13.2 | 13.3 |

C (C—C): Compositional ratio of carbon atoms having a C—C bond.

TABLE 23

| Conditions | Layer structure: Photoconductive layer | Surface layer |
|---|---|---|
| Gas flow rate: (sccm) | | |
| $SiH_4$ | 370 | 200 |
| $CH_4$ | 0 | 450 |
| $Si(CH_3)_4$ | 90 → 0 | 0 |
| NO (ppm)* | 1,000 | 0 |
| $SiF_4$ (ppm)* | 50 | 0 |
| $B_2H_6$ (ppm)* | 50 | 0 |
| $H_2$ | 200 | 500 |

TABLE 23-continued

| Conditions | Layer structure: Photoconductive layer | Surface layer |
|---|---|---|
| Pressure: (mTorr) | 10 | 10 |
| Microwave power: (W) | 1,000 | 1,000 |
| Bias voltage: (V) | 100 | 100 |
| Layer thickness: (μm) | 25 | 0.5 |

*(based on $SiH_4$)

TABLE 24

| Conditions | Layer structure: Photoconductive layer | Surface layer |
|---|---|---|
| Gas flow rate: (sccm) | | |
| $SiH_4$ | 100 | 200 |
| $CH_4$ | 0 | 450 |
| $Si(CH_3)_4$ | 400 → 0 | 0 |
| NO (ppm)* | 1,000 | 0 |
| $SiF_4$ (ppm)* | 50 | 0 |
| $B_2H_6$ (ppm)* | 50 | 0 |
| $H_2$ | 200 | 500 |
| Pressure: (mTorr) | 10 | 10 |
| Microwave power: (W) | 1,000 | 1,000 |
| Bias voltage: (V) | 100 | 100 |
| Layer thickness: (μm) | 25 | 0.5 |

*(based on $SiH_4$)

TABLE 25

| | Example 5 | Comparative Example 3 |
|---|---|---|
| Sensitivity: | AA | A |
| Ghost: | AA | A |
| Charge performance: | AA | AA |
| Residual potential: | AA | B |
| Temperature characteristics: | AA | AA |

TABLE 26

| Elements | Compositional ratio (at. %): Example 5 | Comparative Example 2 |
|---|---|---|
| Si (total) | 64.3 → 70.5 | 53.2 → 69.1 |
| H (total) | 16.1 → 29.5 | 12.6 → 30.9 |
| C (total) | 19.6 → 0 | 35.2 → 0 |
| C (C—C) | 2.1 → 0 | 5.2 → 0 |

C (C—C): Compositional ratio of carbon atoms having a C—C bond.

TABLE 27

| Conditions | Layer structure: Photoconductive layer | Surface layer |
|---|---|---|
| Gas flow rate: (sccm) | | |
| $SiH_4$ | 500 | 50 |
| $CH_4$ | 0 | 600 |
| $Si(CH_3)_4$ | 100 | 0 |
| NO (ppm)* | 1,500 | 0 |
| $SiF_4$ (ppm)* | 70 | 0 |
| $B_2H_6$ (ppm)* | 70 | 0 |
| $H_2$ | 500 | 500 |
| Pressure: (mTorr) | 50 | 50 |
| High-frequency power: (105 MHz) (W) | 500 | 0 |
| High-frequency power: (13.56 MHz) (W) | 0 | 300 |

TABLE 27-continued

| Conditions | Layer structure: Photoconductive layer | Surface layer |
|---|---|---|
| Layer thickness: (μm) | 25 | 0.5 |

*(based on $SiH_4$)

TABLE 28

| Conditions | Layer structure: Photoconductive layer | Surface layer |
|---|---|---|
| Gas flow rate: (sccm) | | |
| $SiH_4$ | 0 | 50 |
| $Si_2H_6$ | 300 | 0 |
| $CH_4$ | 0 | 600 |
| $Si(CH_3)_4$ | 100 | 0 |
| NO (ppm)* | 1,500 | 0 |
| $SiF_4$ (ppm)* | 70 | 0 |
| $B_2H_6$ (ppm)* | 70 | 0 |
| $H_2$ | 500 | 500 |
| Pressure: (mTorr) | 50 | 50 |
| High-frequency power: (105 MHz) (W) | 500 | 0 |
| High-frequency power: (13.56 MHz) (W) | 0 | 300 |
| Layer thickness: (μm) | 25 | 0.5 |

*(based on $SiH_4$)

TABLE 29

| Conditions | Layer structure: Photoconductive layer | Surface layer |
|---|---|---|
| Gas flow rate: (sccm) | | |
| $SiH_4$ | 500 | 50 |
| $CH_4$ | 0 | 600 |
| $Si(CH_3)_4$ | 100 | 0 |
| NO (ppm)* | 1,500 | 0 |
| $SiF_4$ (ppm)* | 70 | 0 |
| $B_2H_6$ (ppm)* | 70 | 0 |
| He | 500 | 500 |
| Pressure: (mTorr) | 50 | 50 |
| High-frequency power: (105 MHz) (W) | 500 | 0 |
| High-frequency power: (13.56 MHz) (W) | 0 | 300 |
| Layer thickness: (μm) | 25 | 0.5 |

*(based on $SiH_4$)

TABLE 30

| Conditions: | 101 | 102 | 103 | 104 | Comparative Experiment |
|---|---|---|---|---|---|
| Gas flow rate: (sccm) | | | | | |
| $SiH_4$ | 350 | 355 | 360 | 365 | 370 |
| $CH_4$ | 0 | 20 | 50 | 70 | 90 |
| $Si(CH_3)_4$ | 80 | 30 | 20 | 10 | 0 |
| $B_2H_6$ (ppm) | 200 | 200 | 200 | 200 | 200 |
| $H_2$ | 100 | 125 | 150 | 175 | 200 |
| Pressure: (mTorr) | 10 | 10 | 10 | 10 | 10 |
| Microwave power: (W) | 1,000 | 1,000 | 1,000 | 1,000 | 1,000 |
| Bias voltage: (V) | 100 | 100 | 100 | 100 | 100 |
| Layer thickness: (μm) | 3 | 3 | 3 | 3 | 3 |

TABLE 31

| Elements | 101 | 102 | 103 | 104 | Comparative Experiment |
|---|---|---|---|---|---|
| | Compositional ratio (at. %) (B: at. ppm) | | | | |
| Si (total) | 63.8 | 62.4 | 58.1 | 59.6 | 57.3 |
| H (total) | 14.6 | 15.2 | 18.5 | 15.4 | 20.1 |
| C (total) | 21.4 | 22.2 | 23.2 | 24.8 | 22.5 |
| C (C—C) | 4.2 | 8.9 | 14.5 | 19.6 | 18.5 |
| B (total) | 2,015 | 2,010 | 2,010 | 2,005 | 2,010 |
| | C (C—C)/C (total) (%) | | | | |
| | 19.6 | 40.2 | 63.3 | 79.1 | 82.3 |

C (C—C): Compositional ratio of carbon atoms having a C—C bond.

TABLE 32

| Conditions | Layer structure: Blocking layer | Photoconductive layer | Surface layer |
|---|---|---|---|
| Gas flow rate: (sccm) | | | |
| $SiH_4$ | Conditions of 101–104 | 350 | 200 |
| $CH_4$ | Conditions of 101–104 | 30 | 400 |
| $Si(CH_3)_4$ | Conditions of 101–104 | 0 | 0 |
| $B_2H_6$ (ppm) | Conditions of 101–104 | 10 | 0 |
| $H_2$ | Conditions of 101–104 | 100 | 100 |
| Pressure: (mTorr) | Conditions of 101–104 | 10 | 10 |
| Microwave power: (W) | Conditions of 101–104 | 1,000 | 1,000 |
| Bias voltage: (V) | Conditions of 101–104 | 100 | 100 |
| Layer thickness: (μm) | Conditions of 101–104 | 25 | 0.5 |

TABLE 33

| Conditions | Layer structure: Blocking layer | Photoconductive layer | Surface layer |
|---|---|---|---|
| Gas flow rate: (sccm) | | | |
| $SiH_4$ | 370 | 350 | 200 |
| $CH_4$ | 90 | 30 | 400 |
| $Si(CH_3)_4$ | 0 | 0 | 0 |
| $B_2H_6$ (ppm) | 200 | 10 | 0 |
| $H_2$ | 200 | 100 | 500 |
| Pressure: (mTorr) | 10 | 10 | 10 |
| Microwave power: (W) | 1,000 | 1,000 | 1,000 |
| Bias voltage: (V) | 100 | 100 | 100 |
| Layer thickness: (μm) | 3 | 25 | 0.5 |

TABLE 34

| | Comparison of Properties: 101 | 102 | 103 | 104 | Comparative Example 4 |
|---|---|---|---|---|---|
| Charge performance: | AA | AA | A | A | B |
| Dark decay: | AA | AA | A | A | B |

TABLE 35

| Conditions | Layer structure: Blocking layer | Photoconductive layer | Surface layer |
|---|---|---|---|
| Gas flow rate: (sccm) | | | |

TABLE 35-continued

| Conditions | Layer structure: Blocking layer | Photoconductive layer | Surface layer |
|---|---|---|---|
| $SiH_4$ | 500 | 500 | 200 |
| $CH_4$ | 100 | 150 | 400 |
| $Si(CH_3)_4$ | 100 | 0 | 0 |
| $B_2H_6$ (ppm) | 200 | 70 | 0 |
| $H_2$ | 500 | 500 | 500 |
| Pressure: (mTorr) | 50 | 50 | 400 |
| High-frequency power: (105 MHz) (W) | 500 | 0 | 0 |
| High-frequency power: (13.56 MHz) (W) | 0 | 300 | 300 |
| Layer thickness: (μm) | 3 | 25 | 0.5 |

TABLE 36

| Comparison of Properties | Example 10 |
|---|---|
| Charge performance: | AA |
| Dark decay: | AA |

TABLE 37

| Conditions | Layer structure: Blocking layer | Photoconductive layer | Surface layer |
|---|---|---|---|
| Gas flow rate: (sccm) | | | |
| $SiH_4$ | 0 | 500 | 200 |
| $Si_{2H6}$ (ppm) | 300 | 0 | |
| $CH_4$ | 100 | 150 | 400 |
| $Si(CH_3)_4$ | 100 | 0 | 0 |
| $B_2H_6$ (ppm) | 200 | 70 | 0 |
| $H_2$ | 500 | 500 | 500 |
| Pressure: (mTorr) | 50 | 50 | 400 |
| High-frequency power: (105 MHz) (W) | 500 | 0 | 0 |
| High-frequency power: (13.56 MHz) (W) | 0 | 300 | 300 |
| Layer thickness: (μm) | 3 | 25 | 0.5 |

TABLE 38

| Conditions | Layer structure: Blocking layer | Photoconductive layer | Surface layer |
|---|---|---|---|
| Gas flow rate: (sccm) | | | |
| $SiH_4$ | 350 | 350 | 200 |
| $CH_4$ | 0 | 30 | 400 |
| $Si(CH_3)_4$ | 80 | 0 | 0 |
| $B_2H_6$ (ppm) | 200 | 10 | 0 |
| He | 100 | 100 | 500 |
| Pressure: (mTorr) | 10 | 10 | 10 |
| Microwave power: (W) | 1,000 | 1,000 | 1,000 |
| Bias voltage: (V) | 100 | 100 | 100 |
| Layer thickness: (μm) | 3 | 25 | 0.5 |

TABLE 39-1

| Conditions: | 101A | 101B | 101C | 101D |
|---|---|---|---|---|
| Gas flow rate: (sccm) | | | | |
| $SiH_4$ | 350 | 350 | 350 | 350 |
| $CH_4$ | 0 | 0 | 0 | 0 |

TABLE 39-1-continued

| Conditions: | 101A | 101B | 101C | 101D |
|---|---|---|---|---|
| $Si(CH_3)_4$ | 80 | 80 | 80 | 80 |
| $B_2H_6$ (ppm) | 200 | 200 | 200 | 200 |
| $H_2$ | 100 | 100 | 100 | 100 |
| $CO_2$/He | 0 | 10 | 200 | 800 |
| Pressure: (mTorr) | 10 | 10 | 10 | 10 |
| Microwave power: (W) | 1,000 | 1,000 | 1,000 | 1,000 |
| Bias voltage: (V) | 100 | 100 | 100 | 100 |
| Layer thickness: (μm) | 3 | 3 | 3 | 3 |

TABLE 39-2

| Conditions: | 102A | 102B | 102C | 102D |
|---|---|---|---|---|
| Gas flow rate: (sccm) | | | | |
| $SiH_4$ | 355 | 355 | 355 | 355 |
| $CH_4$ | 20 | 20 | 20 | 20 |
| $Si(CH_3)_4$ | 30 | 30 | 30 | 30 |
| $B_2H_6$ (ppm) | 200 | 200 | 200 | 200 |
| $H_2$ | 125 | 125 | 125 | 125 |
| $CO_2$/He | 0 | 10 | 200 | 800 |
| Pressure: (mTorr) | 10 | 10 | 10 | 10 |
| Microwave power: (W) | 1,000 | 1,000 | 1,000 | 1,000 |
| Bias voltage: V) | 100 | 100 | 100 | 100 |
| Layer thickness: (μm) | 3 | 3 | 3 | 3 |

TABLE 39-3

| Conditions: | 103A | 103B | 103C | 103D |
|---|---|---|---|---|
| Gas flow rate: (sccm) | | | | |
| $SiH_4$ | 360 | 360 | 360 | 360 |
| $CH_4$ | 50 | 50 | 50 | 50 |
| $Si(CH_3)_4$ | 20 | 20 | 20 | 20 |
| $B_2H_6$ (ppm) | 200 | 200 | 200 | 200 |
| $H_2$ | 150 | 150 | 150 | 150 |
| $CO_2$/He | 0 | 10 | 200 | 800 |
| Pressure: (mTorr) | 10 | 10 | 10 | 10 |
| Microwave power: (W) | 1,000 | 1,000 | 1,000 | 1,000 |
| Bias voltage: (V) | 100 | 100 | 100 | 100 |
| Layer thickness: (μm) | 3 | 3 | 3 | 3 |

TABLE 39-4

| Conditions: | 104A | 104B | 104C | 104D |
|---|---|---|---|---|
| Gas flow rate: (sccm) | | | | |
| $SiH_4$ | 365 | 365 | 365 | 365 |
| $CH_4$ | 70 | 70 | 70 | 70 |
| $Si(CH_3)_4$ | 10 | 10 | 10 | 10 |
| $B_2H_6$ (ppm) | 200 | 200 | 200 | 200 |
| $H_2$ | 175 | 175 | 175 | 175 |
| $CO_2$/He | 0 | 10 | 200 | 800 |
| Pressure: (mTorr) | 10 | 10 | 10 | 10 |
| Microwave power: (W) | 1,000 | 1,000 | 1,000 | 1,000 |
| Bias voltage: (V) | 100 | 100 | 100 | 100 |
| Layer thickness: (μm) | 3 | 3 | 3 | 3 |

TABLE 39-5

| Conditions: | 105A | 105B | 105C | 105D |
|---|---|---|---|---|
| Gas flow rate: (sccm) | | | | |
| $SiH_4$ | 370 | 370 | 370 | 370 |
| $CH_4$ | 90 | 90 | 90 | 90 |
| $Si(CH_3)_4$ | 0 | 0 | 0 | 0 |
| $B_2H_6$ (ppm) | 200 | 200 | 200 | 200 |
| $H_2$ | 200 | 200 | 200 | 200 |
| $CO_2$/He | 0 | 10 | 200 | 800 |
| Pressure: (mTorr) | 10 | 10 | 10 | 10 |
| Microwave power: (W) | 1,000 | 1,000 | 1,000 | 1,000 |
| Bias voltage: (V) | 100 | 100 | 100 | 100 |
| Layer thickness: (μm) | 3 | 3 | 3 | 3 |

TABLE 40-1

| Elements | 101A | 101B | 101C | 101D |
|---|---|---|---|---|
| | Compositional ratio (at. %) (O: at. ppm) | | | |
| O (total) | 5.2 | 30.5 | 2,090 | 51,200 |
| Si (total) | 63.8 | 62.4 | 58.1 | 57.6 |
| H (total) | 14.6 | 15.2 | 18.5 | 14.4 |
| C (total) | 21.5 | 22.3 | 23.2 | 23.0 |
| C (C—C) | 4.2 | 6.0 | 3.2 | 5.1 |
| | C (C—C)/C (total) (%) | | | |
| | 19.5 | 26.9 | 13.8 | 22.2 |

C (C—C): Compositional ratio of carbon atoms having a C—C bond.

TABLE 40-2

| Elements | 102A | 102B | 102C | 102D |
|---|---|---|---|---|
| | Compositional ratio (at. %) (O: at. ppm) | | | |
| O (total) | 4.9 | 31.5 | 2,190 | 55,200 |
| Si (total) | 62.8 | 62.4 | 58.1 | 56.6 |
| H (total) | 15.6 | 14.2 | 18.5 | 15.4 |
| C (total) | 21.5 | 23.3 | 23.1 | 23.0 |
| C (C—C) | 8.0 | 9.8 | 10.1 | 7.7 |
| | C (C—C)/C (total) (%) | | | |
| | 37.2 | 42.1 | 43.7 | 33.5 |

C (C—C): Compositional ratio of carbon atoms having a C—C bond.

TABLE 40-3

| Elements | 103A | 103B | 103C | 103D |
|---|---|---|---|---|
| | Compositional ratio (at. %) (O: at. ppm) | | | |
| O (total) | 4.9 | 31.5 | 2,190 | 53,100 |
| Si (total) | 62.7 | 62.0 | 58.1 | 56.6 |
| H (total) | 15.6 | 14.1 | 18.6 | 16.4 |
| C (total) | 21.6 | 23.8 | 23.1 | 22.0 |
| C (C—C) | 13.9 | 14.8 | 13.8 | 14.9 |
| | (C (C—C)/C (total) (%) | | | |
| | 64.4 | 62.2 | 59.7 | 67.7 |

C (C—C): Compositional ratio of carbon atoms having a C—C bond.

TABLE 40-4

| Elements | 104A | 104B | 104C | 104D |
|---|---|---|---|---|
| | Compositional ratio (at. %) (O: at. ppm) | | | |
| O (total) | 4.4 | 33.5 | 2,590 | 55,900 |
| Si (total) | 62.6 | 61.4 | 58.1 | 56.6 |
| H (total) | 15.6 | 14.2 | 18.7 | 16.2 |
| C (total) | 21.8 | 24.3 | 23.0 | 22.2 |
| C (C—C) | 16.0 | 18.8 | 17.9 | 16.9 |
| | (C (C—C)/C (total) (%) | | | |
| | 73.4 | 77.4 | 77.8 | 76.1 |

C (C—C): Compositional ratio of carbon atoms having a C—C bond.

TABLE 40-5

| Elements | 105A | 105B | 105C | 105D |
|---|---|---|---|---|
| | Compositional ratio (at. %) (O: at. ppm) | | | |
| O (total) | 3.9 | 40.1 | 3,090 | 54,400 |
| Si (total) | 61.9 | 62.4 | 59.1 | 56.1 |
| H (total) | 15.6 | 13.7 | 19.5 | 15.0 |
| C (total) | 22.5 | 23.8 | 21.1 | 23.9 |
| C (C—C) | 20.0 | 19.7 | 18.8 | 19.5 |
| | (C (C—C)/C (total) (%) | | | |
| | 88.9 | 82.8 | 89.1 | 81.6 |

C (C—C): Compositional ratio of carbon atoms having a C—C bond.

TABLE 41

| Conditions | Layer structure: Blocking layer | Photoconductive layer | Surface layer |
|---|---|---|---|
| Gas flow rate: (sccm) | | | |
| $SiH_4$ | Conditions of 101–104 | 350 | 200 |
| $CH_4$ | Conditions of 101–104 | 30 | 400 |
| $Si(CH_3)_4$ | Conditions of 101–104 | 0 | 0 |
| $B_2H_6$ (ppm) | Conditions of 101–104 | 10 | 0 |
| $H_2$ | Conditions of 101–104 | 100 | 100 |
| Pressure: (mTorr) | Conditions of 101–104 | 10 | 10 |
| Microwave power: (W) | Conditions of 101–104 | 1,000 | 1,000 |
| Bias voltage: (V) | Conditions of 101–104 | 100 | 100 |
| Layer thickness: (μm) | Conditions of 101–104 | 25 | 0.5 |

TABLE 42

| Conditions | Layer structure: Blocking layer | Photoconductive layer | Surface layer |
|---|---|---|---|
| Gas flow rate: (sccm) | | | |
| $SiH_4$ | Conditions of 105A–105D | 350 | 200 |
| $CH_4$ | Conditions of 105A–105D | 30 | 400 |
| $Si(CH_3)_4$ | Conditions of 105A–105D | 0 | 0 |
| $B_2H_6$ (ppm) | Conditions of 105A–105D | 10 | 0 |
| $H_2$ | Conditions of 105A–105D | 100 | 500 |
| Pressure: (mTorr) | Conditions of 105A–105D | 10 | 10 |
| Microwave power: (W) | Conditions of 105A–105D | 1,000 | 1,000 |
| Bias voltage: (V) | Conditions of 105A–105D | 100 | 100 |
| Layer thickness: (μm) | Conditions of 101–104 | 25 | 0.5 |

TABLE 43-1

| | 101A | 101B | 101C | 101D |
|---|---|---|---|---|
| Charge performance: | AA | AA | AA | A |
| Dark decay: | AA | AA | AA | B |
| White dots: | B | AA | AA | A |
| Black dots: | A | AA | AA | AA |
| Ghost: | A | AA | AA | A |
| Blank memory: | B | AA | AA | A |

TABLE 43-2

| | 102A | 102B | 102C | 102D |
|---|---|---|---|---|
| Charge performance: | AA | AA | AA | A |
| Dark decay: | AA | AA | AA | B |
| White dots: | B | AA | AA | A |
| Black dots: | AA | AA | AA | A |
| Ghost: | A | AA | AA | A |
| Blank memory: | B | AA | AA | A |

TABLE 43-3

| | 103A | 103B | 103C | 103D |
|---|---|---|---|---|
| Charge performance: | A | A | A | B |
| Dark decay: | A | A | A | A |
| White dots: | B | AA | AA | A |
| Black dots: | A | AA | AA | A |
| Ghost: | A | AA | AA | A |
| Blank memory: | A | AA | AA | A |

TABLE 43-4

| | 104A | 104B | 104C | 104D |
|---|---|---|---|---|
| Charge performance: | A | A | A | B |
| Dark decay: | A | A | A | A |
| White dots: | B | AA | AA | A |
| Black dots: | A | AA | AA | A |
| Ghost: | A | AA | AA | A |
| Blank memory: | B | AA | AA | A |

TABLE 43-5

| | 105A | 105B | 105C | 105D |
|---|---|---|---|---|
| Charge performance: | B | B | B | C |
| Dark decay: | B | B | B | C |
| White dots: | B | A | A | A |
| Black dots: | B | A | A | A |
| Ghost: | B | B | B | B |
| Blank memory: | C | B | B | B |

TABLE 44

| | Layer structure | | |
|---|---|---|---|
| Conditions | Blocking layer | Photoconductive layer | Surface layer |
| Gas flow rate: (sccm) | | | |
| $SiH_4$ | 500 | 500 | 200 |
| $CH_4$ | 100 | 150 | 400 |
| $Si(CH_3)_4$ | 100 | 0 | 0 |
| $B_2H_6$ (ppm) | 200 | 70 | 0 |
| $H_2$ | 500 | 500 | 500 |
| $CO_2$ | 20 | 0 | 0 |
| Pressure: (mTorr) | 50 | 50 | 400 |
| High-frequency power: (105 MHz) (W) | 500 | 0 | 0 |
| High-frequency power: (13.56 MHz) (W) | 0 | 300 | 300 |
| Layer thickness: (μm) | 3 | 25 | 0.5 |

TABLE 45

| | Layer structure | | |
|---|---|---|---|
| Conditions | Blocking layer | Photoconductive layer | Surface layer |
| Gas flow rate: (sccm) | | | |
| $SiH_4$ | 0 | 500 | 200 |
| $Si_2H_6$ | 300 | 0 | |
| $CH_4$ | 100 | 150 | 400 |
| $Si(CH_3)_4$ | 100 | 0 | 0 |
| $B_2H_6$ (ppm) | 200 | 70 | 0 |
| $H_2$ | 500 | 500 | 500 |

TABLE 45-continued

| | Layer structure | | |
|---|---|---|---|
| Conditions | Blocking layer | Photoconductive layer | Surface layer |
| $CO_2$ | 20 | 0 | 0 |
| Pressure: (mTorr) | 50 | 50 | 400 |
| High-frequency power: (105 MHz) (W) | 500 | 0 | 0 |
| High-frequency power: (13.56 MHz) (W) | 0 | 300 | 300 |
| Layer thickness: (μm) | 3 | 25 | 0.5 |

TABLE 46

| | Layer structure | | |
|---|---|---|---|
| Conditions | Blocking layer | Photoconductive layer | Surface layer |
| Gas flow rate: (sccm) | | | |
| $SiH_4$ | 350 | 350 | 200 |
| $CH_4$ | 0 | 30 | 400 |
| $Si(CH_3)_4$ | 80 | 0 | 0 |
| $B_2H_6$ (ppm) | 200 | 10 | 0 |
| $H_2$ | 100 | 100 | 500 |
| $CO_2$ | 20 | 0 | 0 |
| Pressure: (mTorr) | 10 | 10 | 10 |
| Microwave power: (W) | 1,000 | 1,000 | 1,000 |
| Bias voltage: (V) | 100 | 100 | 100 |
| Layer thickness: (μm | 3 | 25 | 0.5 |

TABLE 47

| | Example | | | |
|---|---|---|---|---|
| | 14 | 15 | 16 | 17 |
| Charge performance: | AA | AA | AA | AA |
| Dark decay: | AA | AA | AA | AA |
| White dots: | AA | AA | AA | AA |
| Black dots: | AA | AA | AA | AA |
| Ghost: | AA | AA | AA | AA |
| Blank memory: | AA | AA | AA | AA |

TABLE 48

| | Layer structure | | |
|---|---|---|---|
| Conditions | Blocking layer | Photoconductive layer | Surface layer |
| Gas flow rate: (sccm) | | | |
| $SiH_4$ | 350 | 350 | 200 |
| $CH_4$ | 0 | 30 | 400 |
| $Si(CH_3)_4$ | 80 | 0 | 0 |
| $B_2H_6$ (ppm) | 200 | 10 | 0 |
| $H_2$ | 100 | 100 | 500 |
| $N_2$ | 20 | 0 | 0 |
| Pressure: (mTorr) | 10 | 10 | 10 |
| Microwave power: (W) | 1,000 | 1,000 | 1,000 |
| Bias voltage: (V) | 100 | 100 | 100 |
| Layer thickness: (μm) | 3 | 25 | 0.5 |

TABLE 49

| | Layer structure | | |
|---|---|---|---|
| Conditions | Blocking layer | Photoconductive layer | Surface layer |
| Gas flow rate: | | | |

TABLE 49-continued

| Conditions | Layer structure: Blocking layer | Photoconductive layer | Surface layer |
|---|---|---|---|
| (sccm) | | | |
| $SiH_4$ | 500 | 500 | 200 |
| $CH_4$ | 100 | 150 | 400 |
| $Si(CH_3)_4$ | 100 | 0 | 0 |
| $B_2H_6$ (ppm) | 200 | 70 | 0 |
| $H_2$ | 500 | 500 | 500 |
| $N_2$ | 20 | 0 | 0 |
| Pressure: (mTorr) | 50 | 50 | 400 |
| High-frequency power: (105 MHz) (W) | 500 | 0 | 0 |
| High-frequency power: (13.56 MHz) (W) | 0 | 300 | 300 |
| Layer thickness: (μm) | 3 | 25 | 0.5 |

TABLE 50

| Conditions | Layer structure: Blocking layer | Photoconductive layer | Surface layer |
|---|---|---|---|
| Gas flow rate: (sccm) | | | |
| $SiH_4$ | 0 | 500 | 200 |
| $Si_2H_6$ | 300 | 0 | |
| $CH_4$ | 100 | 150 | 400 |
| $Si(CH_3)_4$ | 100 | 0 | 0 |
| $B_2H_6$ (ppm) | 200 | 70 | 0 |
| $H_2$ | 500 | 500 | 500 |
| $N_2$ | 20 | 0 | 0 |
| Pressure: (mTorr) | 50 | 50 | 400 |
| High-frequency power: (105 MHz) (W) | 500 | 0 | 0 |
| High-frequency power: (13.56 MHz) (W) | 0 | 300 | 300 |
| Layer thickness: (μm) | 3 | 25 | 0.5 |

TABLE 51

| Conditions | Layer structure: Blocking layer | Photoconductive layer | Surface layer |
|---|---|---|---|
| Gas flow rate: (sccm) | | | |
| $SiH_4$ | 350 | 350 | 200 |
| $CH_4$ | 0 | 30 | 400 |
| $Si(CH_3)_4$ | 80 | 0 | 0 |
| $B_2H_6$ (ppm) | 200 | 10 | 0 |
| He | 100 | 100 | 500 |
| $N_2$ | 20 | 0 | 0 |
| Pressure: (mTorr) | 10 | 10 | 10 |
| Microwave power: (W) | 1,000 | 1,000 | 1,000 |
| Bias voltage: (V) | 100 | 100 | 100 |
| Layer thickness: (μm) | 3 | 25 | 0.5 |

TABLE 52

| Conditions | Layer structure: Blocking layer | Photoconductive layer | Surface layer |
|---|---|---|---|
| Gas flow rate: (sccm) | | | |
| $SiH_4$ | 350 | 350 | 200 |
| $CH_4$ | 0 | 30 | 400 |
| $Si(CH_3)_4$ | 80 | 0 | 0 |
| $B_2H_6$ (ppm) | 200 | 10 | 0 |

TABLE 52-continued

| Conditions | Layer structure: Blocking layer | Photoconductive layer | Surface layer |
|---|---|---|---|
| $H_2$ | 100 | 100 | 500 |
| $O_2$ | 20 | 0 | 0 |
| $N_2$ | 20 | 0 | 0 |
| Pressure: (mTorr) | 10 | 10 | 10 |
| Microwave power: (W) | 1,000 | 1,000 | 1,000 |
| Bias voltage: (V) | 100 | 100 | 100 |
| Layer thickness: (μm) | 3 | 25 | 0.5 |

TABLE 53

| Conditions | Layer structure: Blocking layer | Photoconductive layer | Surface layer |
|---|---|---|---|
| Gas flow rate: (sccm) | | | |
| $SiH_4$ | 500 | 500 | 200 |
| $CH_4$ | 100 | 150 | 400 |
| $Si(CH_3)_4$ | 100 | 0 | 0 |
| $B_2H_6$ (ppm) | 200 | 70 | 0 |
| $H_2$ | 500 | 500 | 500 |
| $O_2$ | 20 | 0 | 0 |
| $N_2$ | 20 | 0 | 0 |
| Pressure: (mTorr) | 50 | 50 | 400 |
| High-frequency power: (105 MHz) (W) | 500 | 0 | 0 |
| High-frequency power: (13.56 MHz) (W) | 0 | 300 | 300 |
| Layer thickness: (μm) | 3 | 25 | 0.5 |

TABLE 54

| Conditions | Layer structure: Blocking layer | Photoconductive layer | Surface layer |
|---|---|---|---|
| Gas flow rate: (sccm) | | | |
| $SiH_4$ | 0 | 500 | 200 |
| $Si_2H_6$ | 300 | 0 | |
| $CH_4$ | 100 | 150 | 400 |
| $Si(CH_3)_4$ | 100 | 0 | 0 |
| $B_2H_6$ (ppm) | 200 | 70 | 0 |
| $H_2$ | 500 | 500 | 500 |
| $O_2$ | 20 | 0 | 0 |
| $N_2$ | 20 | 0 | 0 |
| Pressure: (mTorr) | 50 | 50 | 400 |
| High-frequency power: (105 MHz) (W) | 500 | 0 | 0 |
| High-frequency power: (13.56 MHz) (W) | 0 | 300 | 300 |
| Layer thickness: (μm) | 3 | 25 | 0.5 |

TABLE 55

| Conditions | Layer structure: Blocking layer | Photoconductive layer | Surface layer |
|---|---|---|---|
| Gas flow rate: (sccm) | | | |
| $SiH_4$ | 350 | 350 | 200 |
| $CH_4$ | 0 | 30 | 400 |
| $Si(CH_3)_4$ | 80 | 0 | 0 |
| $B_2H_6$ (ppm) | 200 | 10 | 0 |
| He | 100 | 100 | 500 |
| $O_2$ | 20 | 0 | 0 |

TABLE 55-continued

| Conditions | Layer structure | | |
|---|---|---|---|
| | Blocking layer | Photoconductive layer | Surface layer |
| $N_2$ | 20 | 0 | 0 |
| Pressure: (mTorr) | 10 | 10 | 10 |
| Microwave power: (W) | 1,000 | 1,000 | 1,000 |
| Bias voltage: (V) | 100 | 100 | 100 |
| Layer thickness: (μm) | 3 | 25 | 0.5 |

What is claimed is:

1. A light-receiving member comprising a conductive substrate and a light-receiving layer having a photoconductive layer comprised of a non-monocrystalline material and a surface layer which are formed in this order on said conductive substrate, wherein;

said photoconductive layer is comprised of a non-monocrystalline material mainly composed of a silicon atom and containing at least a carbon atom and a hydrogen atom; and carbon atoms having a carbon-carbon bond in the photoconductive layer are in a percentage of not more than 60% based on the whole carbon atoms contained in the photoconductive layer.

2. The light-receiving member according to claim 1, wherein the carbon atoms having a carbon-carbon bond in said photoconductive layer are in a percentage of not more than 30% based on the whole carbon atoms contained in the photoconductive layer.

3. The light-receiving member according to claim 1, wherein the carbon atoms in said photoconductive layer is in a content of from 3 atom % to 30 atom % in the surface, or in the vicinity of the surface, of the photoconductive layer on its side of the conductive substrate.

4. The light-receiving member according to claim 1, wherein the carbon atoms in said photoconductive layer is in a content so changing as to be largest in the surface, or in the vicinity of the surface, of the photoconductive layer on its side of the conductive substrate and substantially 0 atom % in the surface, or in the vicinity of the surface, thereof on its side of the surface layer.

5. The light-receiving member according to claim 1, wherein said photoconductive layer comprises said non-monocrystalline material, which further contains at least one of an oxygen atom and a nitrogen atom.

6. The light-receiving member according to claim 5, wherein said carbon atoms having a carbon-carbon bond in the photoconductive layer are in a percentage of not more than 30% based on the whole carbon atoms contained in the photoconductive layer.

7. The light-receiving member according to claim 5, wherein the carbon atoms in said photoconductive layer is in a content of from 3 atom % to 30 atom % in the surface, or in the vicinity of the surface, of the photoconductive layer on its side of the conductive substrate.

8. The light-receiving member according to claim 5, wherein the carbon atoms in said photoconductive layer is in a content so changing as to be largest in the surface, or in the vicinity of the surface, of the photoconductive layer on its side of the conductive substrate and substantially 0 atom % in the surface, or in the vicinity of the surface, thereof on its side of the surface layer.

9. The light-receiving member according to claim 5, wherein the oxygen atoms in said photoconductive layer are in a content of from 10 atom ppm to 5,000 atom ppm.

10. The light-receiving member according to claim 5, wherein the nitrogen atoms in said photoconductive layer are in a content of from 10 atom ppm to 5,000 atom ppm.

11. The light-receiving member according to claim 5, wherein said photoconductive layer further contains a fluorine atom.

12. The light-receiving member according to claim 11, wherein said fluorine atom is in a content of from 1 atom ppm to 95 atom ppm.

13. A light-receiving member comprising a conductive substrate and a light-receiving layer having i) a blocking layer comprised of a non-monocrystal, ii) a photoconductive layer and iii) a surface layer which are successively formed on said conductive substrate, wherein;

said blocking layer is comprised of a non-monocrystalline material mainly composed of a silicon atom, containing at least a carbon atom and a hydrogen atom and further containing a boron atom; and carbon atoms in said blocking layer (C/Si+C) are in a content of not less than 3 atom % to not more than 50 atom %, and carbon atoms having a carbon-carbon bond in the blocking layer are in a percentage of not more than 80% based on the whole carbon atoms contained in the blocking layer.

14. The light-receiving member according to claim 13, wherein said carbon atoms having a carbon-carbon bond in the blocking layer are in a percentage of not more than 50% based on the whole carbon atoms contained in the blocking layer.

15. A light-receiving member comprising a conductive substrate and a light-receiving layer having i) a blocking layer comprised of a non-monocrystal, ii) a photoconductive layer and iii) a surface layer which are successively formed on said conductive substrate, wherein;

said blocking layer is comprised of a non-monocrystalline material mainly composed of a silicon atom, containing at least a carbon atom and a hydrogen atom and further containing at least one of an oxygen atom and a nitrogen atom; and carbon atoms in said blocking layer {C/(Si+C)} are in a content of not less than 3 atom % to not more than 50 atom %, and carbon atoms having a carbon-carbon bond in the blocking layer are in a percentage of not more than 80% based on the whole carbon atoms contained in the blocking layer.

16. The light-receiving member according to claim 15, wherein said carbon atoms having a carbon-carbon bond in the blocking layer are in a percentage of not more than 50% based on the whole carbon atoms contained in the blocking layer.

17. The light-receiving member according to claim 15, wherein the oxygen atoms in said blocking layer {O/(Si+C+O)} are in a content of not less than 10 atom ppm to not more than 50,000 atom ppm.

18. The light-receiving member according to claim 15, wherein the nitrogen atoms in said blocking layer {N/(Si+C+N)} are in a content of not less than 10 atom ppm to not more than 50,000 atom ppm.

19. The light-receiving member according to claim 15, wherein the oxygen atoms and nitrogen atoms in said blocking layer {O+N/(Si+C+O+N)} are in a content of not less than 20 atom ppm to not more than 100,000 atom ppm.

20. The light-receiving member according to claim 15, wherein said blocking layer further contains boron.

21. The light-receiving member according to claim 1, which further comprises a blocking layer provided directly or indirectly between said conductive substrate and said photoconductive layer;

said blocking layer being comprised of a non-monocrystalline material mainly composed of a silicon atom, containing at least a carbon atom and a hydrogen atom and further containing a boron atom; and carbon atoms in said blocking layer (C/Si+C) being in a content of not less than 3 atom % to not more than 50 atom %, and carbon atoms having a carbon-carbon bond in the blocking layer being in a percentage of not more than 80% based on the whole carbon atoms contained in the blocking layer.

22. The light-receiving member according to claim 21, wherein said carbon atoms having a carbon-carbon bond in the blocking layer are in a percentage of not more than 50% based on the whole carbon atoms contained in the blocking layer.

23. The light-receiving member according to claim 1, which further comprises a blocking layer provided directly or indirectly between said conductive substrate and said photoconductive layer;

said blocking layer being comprised of a non-monocrystalline material mainly composed of a silicon atom, containing at least a carbon atom and a hydrogen atom and further containing at least one of an oxygen atom and a nitrogen atom; and carbon atoms in said blocking layer {C/(Si+C)} being in a content of not less than 3 atom % to not more than 50 atom %, and carbon atoms having a carbon-carbon bond in the blocking layer being in a percentage of not more than 80% based on the whole carbon atoms contained in the blocking layer.

24. The light-receiving member according to claim 23, wherein the carbon atoms having a carbon-carbon bond in the blocking layer are in a percentage of not more than 50% based on the whole carbon atoms contained in the blocking layer.

25. The light-receiving member according to claim 23, wherein the oxygen atoms in said blocking layer {O/(Si+C+O)} are in a content of not less than 10 atom ppm to not more than 50,000 atom ppm.

26. The light-receiving member according to claim 23, wherein the nitrogen atoms in said blocking layer {N/(Si+C+N)} are in a content of not less than 10 atom ppm to not more than 50,000 atom ppm.

27. The light-receiving member according to claim 23, wherein the oxygen atoms and nitrogen atoms in said blocking layer {O+N/(Si+C+O+N)} are in a content of not less than 20 atom ppm to not more than 100,000 atom ppm.

28. The light-receiving member according to claim 23, wherein said blocking layer further contains boron.

29. The light-receiving member according to claim 5, which further comprises a blocking layer provided directly or indirectly between said conductive substrate and said photoconductive layer;

said blocking layer being comprised of a non-monocrystalline material mainly composed of a silicon atom, containing at least a carbon atom and a hydrogen atom and further containing a boron atom; and carbon atoms in said blocking layer (C/Si+C) being in a content of not less than 3 atom % to not more than 50 atom %, and carbon atoms having a carbon-carbon bond in the blocking layer being in a percentage of not more than 80% based on the whole carbon atoms contained in the blocking layer.

30. The light-receiving member according to claim 29, wherein said carbon atoms having a carbon-carbon bond in the blocking layer are in a percentage of not more than 50% based on the whole carbon atoms contained in the blocking layer.

31. The light-receiving member according to claim 5, which further comprises a blocking layer provided directly or indirectly between said conductive substrate and said photoconductive layer;

said blocking layer being comprised of a non-monocrystalline material mainly composed of a silicon atom, containing at least a carbon atom and a hydrogen atom and further containing at least one of an oxygen atom and a nitrogen atom; and carbon atoms in said blocking layer {C/(Si+C)} being in a content of not less than 3 atom % to not more than 50 atom %, and carbon atoms having a carbon-carbon bond in the blocking layer being in a percentage of not more than 80% based on the whole carbon atoms contained in the blocking layer.

32. The light-receiving member according to claim 31, wherein said carbon atoms having a carbon-carbon bond in the blocking layer are in a percentage of not more than 50% based on the whole carbon atoms contained in the blocking layer.

33. The light-receiving member according to claim 31, wherein the oxygen atoms in said blocking layer {O/(Si+C+O)} are in a content of not less than 10 atom ppm to not more than 50,000 atom ppm.

34. The light-receiving member according to claim 31, wherein the nitrogen atoms in said blocking layer {N/(Si+C+N)} are in a content of not less than 10 atom ppm to not more than 50,000 atom ppm.

35. The light-receiving member according to claim 31, wherein the oxygen atoms and nitrogen atoms in said blocking layer {O+N/(Si+C+O+N)} are in a content of not less than 20 atom ppm to not more than 100,000 atom ppm.

36. The light-receiving member according to claim 31, wherein said blocking layer further contains boron.

37. A light-receiving member comprising a photoconductive layer having a photoconductivity, wherein;

said photoconductive layer is comprised of a non-monocrystalline material mainly composed of a silicon atom and containing at least a carbon atom and a hydrogen atom; and carbon atoms having a carbon-carbon bond in the photoconductive layer are in a percentage of not more than 60% based on the whole carbon atoms contained in the photoconductive layer.

38. The light-receiving member according to claim 37, wherein said carbon atoms having a carbon-carbon bond in the photoconductive layer are in a percentage of not more than 30% based on the whole carbon atoms contained in the photoconductive layer.

39. The light-receiving member according to claim 37, wherein the carbon atoms in said photoconductive layer is in a content of from 3 atom % to 30 atom % in the surface, or in the vicinity of the surface, of the photoconductive layer on its side of the conductive substrate.

40. The light-receiving member according to claim 37, wherein the carbon atoms in said photoconductive layer is in a content so changing as to be largest in the surface, or in the vicinity of the surface, of the photoconductive layer on its side of the conductive substrate and substantially 0 atom % in the surface, or in the vicinity of the surface, thereof on its side of the surface layer.

41. The light-receiving member according to claim 37, wherein said photoconductive layer comprises said non-monocrystalline material, which further contains at least one of an oxygen atom and a nitrogen atom.

42. The light-receiving member according to claim 41, wherein said carbon atoms having a carbon-carbon bond in the photoconductive layer are in a percentage of not more than 30% based on the whole carbon atoms contained in the photoconductive layer.

43. The light-receiving member according to claim 41, wherein the carbon atoms in said photoconductive layer is in a content of from 3 atom % to 30 atom % in the surface, or in the vicinity of the surface, of the photoconductive layer on its side of the conductive substrate.

* * * * *

UNITED STATES PATENT AND TRADEMARK OFFICE

CERTIFICATE OF CORRECTION

PATENT NO. : 5,407,768

DATED : April 18, 1995

INVENTOR(S) : KAZUYOSHI AKIYAMA, ET AL.

It is certified that error appears in the above-identified patent and that said Letters Patent is hereby corrected as shown below:

ON TITLE PAGE

In [56] References Cited, under FOREIGN PATENT DOCUMENTS:
"61-231561 10/1980 Japan" should read
--61-231561 10/1986 Japan--.

COLUMN 1

Line 65, "lest" should read --least--.

COLUMN 8

Line 35, "a more" should be deleted.

COLUMN 13

Line 12, "less" should read --fewer--.
Line 29, "well" should read --quite--.
Line 57, "well" should be deleted.

COLUMN 14

Line 53, "preferably in" should read --preferably be in--.

COLUMN 21

Line 20, "lowered" should read --lowered due--.
Line 57, "well" should be deleted.

COLUMN 22

Line 41, "5×104" should read --$5\times10^4$--.

UNITED STATES PATENT AND TRADEMARK OFFICE

CERTIFICATE OF CORRECTION

PATENT NO. : 5,407,768

DATED : April 18, 1995

INVENTOR(S) : KAZUYOSHI AKIYAMA, ET AL.

It is certified that error appears in the above-identified patent and that said Letters Patent is hereby corrected as shown below:

COLUMN 23

Line 22, "($n_2O$)," should read --($N_2O$),--.

COLUMN 24

Line 58, "butine" should read --butyne--.

COLUMN 36

Line 44, "Canon Inc" should read --Canon Inc.--.

COLUMN 40

Line 61, ""black dotes"" should read --"black dots"--.

COLUMN 52

TABLE 42, "Conditions of 101-104" should read -- Conditions of 105A-105D --.

COLUMN 57

Line 35, "is" should read --are--.
Line 41, "is" should read --are--.
Line 59, "is" should read --are--.
Line 65, "is" should read --are--.

COLUMN 61

Line 5, "is" should read --are--.
Line 11, "is" should read --are--.

UNITED STATES PATENT AND TRADEMARK OFFICE

CERTIFICATE OF CORRECTION

PATENT NO. : 5,407,768

DATED : April 18, 1995

INVENTOR(S) : KAZUYOSHI AKIYAMA, ET AL.

It is certified that error appears in the above-indentified patent and that said Letters Patent is hereby corrected as shown below:

COLUMN 62

Line 12, "is" should read --are--.

Signed and Sealed this

Fifteenth Day of August, 1995

Bruce Lehman

*Attest:*

BRUCE LEHMAN

*Attesting Officer*

*Commissioner of Patents and Trademarks*